US011751689B2

(12) United States Patent
Pesek et al.

(10) Patent No.: US 11,751,689 B2
(45) Date of Patent: Sep. 12, 2023

(54) HEIGHT ADJUSTABLE CHAIR

(71) Applicant: Peak Degrees, LLC, Trophy Club, TX (US)

(72) Inventors: Christopher Pesek, Trophy Club, TX (US); William Xiques, Beachwood, NJ (US); Tao Xu, Stateline, NV (US)

(73) Assignee: Peak Degrees Holdings LLC, Trophy Club, TX (US)

( * ) Notice: Subject to any disclaimer, the term of this patent is extended or adjusted under 35 U.S.C. 154(b) by 7 days.

(21) Appl. No.: 17/486,157

(22) Filed: Sep. 27, 2021

(65) Prior Publication Data

US 2022/0007837 A1 Jan. 13, 2022

Related U.S. Application Data

(63) Continuation-in-part of application No. 16/229,194, filed on Dec. 21, 2018, now Pat. No. 11,129,477.

(60) Provisional application No. 63/120,760, filed on Dec. 3, 2020.

(51) Int. Cl.
*A47C 4/12* (2006.01)
*A47C 4/04* (2006.01)

(52) U.S. Cl.
CPC . *A47C 4/12* (2013.01); *A47C 4/04* (2013.01)

(58) Field of Classification Search
CPC ..... A47C 4/12
USPC ..... 297/39–40
See application file for complete search history.

(56) References Cited

U.S. PATENT DOCUMENTS 3,025,101 A * 3/1962 McKinnie ..... A47C 13/00 182/125
4,557,350 A * 12/1985 Wang ..... A47C 12/02 297/118
6,062,639 A * 5/2000 Hill ..... A47C 4/20 297/39
6,095,607 A * 8/2000 Wenzel ..... A47C 3/34 297/118
7,086,694 B1 * 8/2006 Huang ..... A47C 4/28 297/39
9,877,587 B2 * 1/2018 Grace ..... A47C 4/12
2004/0099479 A1 * 5/2004 Sagol ..... E06C 1/393 182/165
2007/0144831 A1 * 6/2007 Cole ..... A47C 12/02 182/33
2018/0338622 A1 * 11/2018 Doolan ..... A47C 4/10

* cited by examiner

*Primary Examiner* — David R Dunn
*Assistant Examiner* — Tania Abraham
(74) *Attorney, Agent, or Firm* — Christopher J. Scott

(57) ABSTRACT

A height adjustable chair includes a user support platform assembly, and posterior and anterior leg assemblies. The user support platform assembly includes first, second, and third platform portions, and a pair of pivot mechanisms. The posterior and anterior leg assemblies include laterally opposed upper leg portions, laterally opposed lower leg portions, and locking mechanisms for locking the lower leg portions in extended relation relative to the upper leg portions. The pivot mechanisms pivotally attach to first platform portion and the posterior leg assembly. The anterior leg assembly is pivotally attached to the posterior leg assembly, the first platform portion, and the third platform portions. The first support platform supports a user thereupon. The anterior and posterior leg assemblies enable the user to vary the height of the first support platform relative to a support surface.

20 Claims, 18 Drawing Sheets

-100-

HEIGHT ADJUSTABLE CHAIR

PRIOR HISTORY

This application is a Continuation-in-Part patent application claiming the benefit of pending U.S. patent application Ser. No. 16/229,194 filed in the United States Patent and Trademark Office (USPTO) on 18 Dec. 2018 and further claims the benefit of U.S. Provisional Patent Application No. 63/120,760 filed in the USPTO on 3 Dec. 2020, the specifications and drawings of both applications being hereby incorporated by reference thereto.

FIELD OF THE INVENTION

The present invention relates generally to a portable, collapsible chair, and more particularly to a portable chair having structural features for enabling a user to vary the user-supportive height of the chair relative to a support surface, while further enabling the user to collapse the chair for ease of transport or portability and storage.

BRIEF DESCRIPTION OF THE PRIOR ART

Portable chairs are a common convenience used by many individuals in many applications. Portable chairs are typically provided in a form whereby they may be converted from a folded or collapsed position or configuration to an unfolded, user-supportive position or configuration. The folded, collapsed position or configuration allows for ease of storage and transport (portability) of the chair from location to location. One common use of the folding chair relates to outdoor recreational activities that allow for convenient opening and folding of a chair for comfortable positioning as needed.

Typically, a folding chair of this general type provides a user-supportive platform at a height of roughly 24 inches from the ground, floor or similar other support surface. It is noted, however, that in certain applications such a relatively low sitting or support position is not optimal for the user. A low sitting position may not provide a satisfying field of vision, for example, and the visibility of the user may thereby be restricted due to obstacles or other individuals. Further many of the chairs of relatively low elevation are used in various sporting events, concerts, beaches or other outdoor activities in which cases a greater field of vision is to be preferred. As such, the prior art perceives a need for a high-rise portable folding chair that enables a user to elevate the seating position when desired.

US Patent Application Publication No. 2020/0196762 ('762 Publication for the High-Rise Sports Chair) based on U.S. patent application Ser. No. 16/229,194, from which this application claims a benefit essentially describes an elevated portable chair comprising a seat and a pair of collapsible legs, wherein the pair includes a front leg assembly and a rear leg assembly, wherein the rear leg assembly extends, and pivots open from a mid-point on the front leg. A rear bracket extends from a rear edge of the seat to a distal end of the rear leg assembly to provide stabilizing support, where a horizontal brace is placed at a midpoint of the rear bracket. Other features of the chair include a back support; first and second armrests; and a solar panel on a top edge of the back support. The solar panel provides a power source for the at least one power outlet provided on the chair.

SUMMARY OF THE INVENTION

The present invention builds upon the subject matter disclosed in the '762 Publication while carrying over various key structural features such as the collapsible feature as well as the leg extendibility of the High-Rise Sports Chair. In this regard, the present invention relates to an elevated portable chair that includes: a seat and a pair of leg assemblies, wherein the pair of leg assemblies includes a front leg assembly and a rear leg assembly, wherein the front leg assembly and rear leg assembly pivot open from a point of attachment to the seat or first platform portion. The legs feature a telescopic leg-expansion and contraction mechanism central to the practice of the invention. In other words, the expansion/contraction mechanism is preferably provided in the form of telescoping tubular leg sections or similar other structure(s), which allow lengthening or shortening of the legs so as to provide the ability for adjusting the overall height of the chair itself.

This structural concept is believed originally supported by the '762 Publication at Paragraph No. 8 where it states that the seat is ideally positioned or placed at 42 inches above the floor or ground level from the bottom of legs to the seat whereafter the overall height of the seat can range up to 60 inches to the top of the backrest. Other features of the height adjustable chair according to the present invention include a back support; and first and second armrests. These armrests can be additionally supplemented with convenience features for the user such a fold-out tray and/or pouch for personal items. Other possible features of the chair can also include a solar panel to be located on some portion of the chair. The solar panel provides a power source for the at least one power outlet provided on the chair. A plurality of steps may further traverse along the length of the front leg assembly and provide ability for the user to mount the seat portion when the chair is in a position of raised height.

More particularly, the basic invention in a first iteration may be said to essentially teach or disclose a height adjustable chair for enabling a user to vary a select user support height thereof. The height adjustable chair according to the present invention is believed to essentially comprise a user support platform assembly, a posterior leg assembly, and an anterior leg assembly. The user support platform assembly preferably comprises a first platform portion or seat portion, and a pair of pivot mechanisms in a preferred embodiment.

Each of the pair of pivot mechanisms comprises an upper pivot axis, a lower pivot axis, a leg bridge portion, a bridge-to-arm portion, and a pivot arm portion. The pair of pivot mechanisms are firstly and pivotally attached to laterally opposed posterior portions of the first platform portion via the leg-bridge portions. The upper pivot axes of the pair of pivot mechanisms are thereby axially aligned at the first platform portion along a first posterior pivot axis of rotation.

The posterior leg assembly essentially comprises laterally opposed upper posterior leg portions, laterally opposed lower posterior leg portions extendable relative to the upper posterior leg portions, and a posterior locking mechanism for locking the lower posterior leg portions in extended relation relative to the upper posterior leg portions. The pair of pivot mechanisms are secondly and pivotally attached to the upper posterior leg portions. The lower pivot axes of the pair of pivot mechanisms are thereby axially aligned at the upper posterior leg portions at a second posterior pivot axis of rotation.

The anterior leg assembly essentially comprises laterally opposed upper anterior leg portions, laterally opposed lower anterior leg portions extendable relative to the upper anterior leg portions, and an anterior locking mechanism for locking the lower anterior leg portions in extended relation relative to the upper anterior leg portions. The upper anterior leg portions are pivotally attached to laterally opposed anterior portions the first platform portion along a first anterior pivot axis of rotation.

The anterior leg assembly is further pivotally attached to the posterior leg assembly at a second leg-to-leg anterior pivot axis of rotation. The first support platform is operable to support a user thereupon. The anterior and posterior leg assemblies together enable the user to vary the height of the first support platform relative to a support surface upon which the height adjustable chair is positioned. The height adjustable chair according to the present invention thereby enables the user to vary a select support height of the chair relative to the support surface.

The user support platform assembly preferably comprises a second platform portion or back support portion, which second platform portion is pivotally attached to the first platform portion at the first posterior pivot axis of rotation. The user support platform assembly further preferably comprises laterally opposed third platform portions, which laterally opposed third platform portions are pivotally attached to laterally opposed portions of the second platform portion along a third posterior pivot axis of rotation as well as being pivotally attached to the second leg-to-leg anterior pivot axis of rotation.

The anterior leg assembly comprises an anterior crossmember and the posterior leg assembly comprises a posterior crossmember. The anterior crossmember maintains a fixed first anterior distance between and stabilizes the lower anterior leg portions, and the posterior crossmember maintains a fixed first posterior distance between and stabilizes the lower posterior leg portions. The anterior locking mechanism extends intermediate lower portions of the upper anterior leg portions and the posterior locking mechanism extends intermediate lower portions of the upper posterior leg portions. The anterior locking mechanism maintains a fixed second anterior distance between and stabilizes the upper anterior leg portions. The posterior locking mechanism maintains a fixed second posterior distance between and stabilizes the lower posterior leg portions.

The anterior leg assembly extends in an anterior leg plane and the posterior leg assembly extends in a posterior leg plane. The anterior leg plane is preferably angled relative to the posterior leg plane at a select oblique angle. The select oblique angle is preferably between 50 and 55 degrees. In the preferred embodiment, the lower anterior leg portions are telescopically receivable in and extendable from the upper anterior leg portions and the lower posterior leg portions are telescopically receivable in and extendable from the upper posterior leg portions. An anterior distance between the first platform portion to a lowermost portion of the lower anterior leg portions provides a first quotient value and a lowermost distance between the lowermost portion of the lower anterior leg portions to a lowermost portion of the lower posterior leg portions provides a second quotient value. The ratio of the first quotient value to the second quotient value is preferably between 0.60 when in a minimum chair height configuration and 0.75 when in a maximum chair height configuration.

The first, second, and third posterior pivot axes are together cooperable with the first and second anterior pivot and the structural features to enable the user to collapse the height adjustable chair into a collapsed configuration for ease of transport and stowage. A select leg assembly may preferably comprise a series of steps as referenced at 36. The select leg assembly is selected from the group consisting of the anterior leg assembly and the posterior leg assembly, and the series of steps enable the user to more readily access the first platform portion when the height adjustable chair is in an elevated configuration relative to the support surface. An anterior-to-posterior leg assembly crossmember mechanism maintains a fixed leg distance between the anterior leg assembly and the posterior leg assembly and stabilizes the same when in a user-support configuration.

The basic invention in a second iteration may be said to essentially teach or disclose a height adjustable chair for enabling a user to vary a select user support height thereof. The alternative height adjustable chair may be said to essentially comprise a user support platform assembly, a posterior leg assembly, and an anterior leg assembly. The user support platform assembly essentially comprises a first platform portion and a pair of pivot mechanisms. The pair of pivot mechanisms each provide first and second pivot axes of rotation, and are firstly and pivotally attached to laterally opposed posterior portions of the user support platform assembly thereby being axially aligned at the first platform portion along a first pivot axis of rotation.

The posterior leg assembly may be said to essentially comprise laterally opposed lower posterior leg portions, laterally opposed upper posterior leg portions extendable relative to the lower posterior leg portions, and a posterior locking mechanism for locking the upper posterior leg portions in extended relation relative to the lower posterior leg portions. The pair of pivot mechanisms secondly and pivotally attach to the upper posterior leg portions thereby being axially aligned at the upper posterior leg portions at a second pivot axis of rotation.

The anterior leg assembly comprising laterally opposed lower anterior leg portions, laterally opposed upper anterior leg portions extendable relative to the lower anterior leg portions, and an anterior locking mechanism for locking the upper anterior leg portions in extended relation relative to the lower anterior leg portions. The upper anterior leg portions are pivotally attached to laterally opposed anterior portions of the first platform portion along a third pivot axis of rotation. The first support platform supports a user, and the anterior and posterior leg assemblies enable the user to vary the height of the first support platform relative to a support surface.

The user support platform assembly of the alternative height adjustable chair may also comprise a second platform portion that pivotally attaches to the first platform portion at the first posterior pivot axis of rotation, and laterally opposed third platform portions that pivotally attach to laterally opposed portions of the second platform portion along a fourth posterior pivot axis of rotation.

The anterior leg assembly preferably comprises at least one anterior crossmember and the posterior leg assembly comprises at least one posterior crossmember. The at least one anterior crossmember maintains a fixed first anterior distance between the lower anterior leg portions and the at least one posterior crossmember maintains a fixed first posterior distance between the lower posterior leg portions.

The upper anterior leg portions of the alternative embodiment are preferably telescopically receivable in and extendable from the lower anterior leg portions and the upper posterior leg portions of the alternative embodiment are telescopically receivable in and extendable from the lower posterior leg portions. This feature is optional and not critical to the practice of the alternative embodiment, and the reader will note that the relative leg-to-leg portion extendibility is central to the practice of the present invention.

The first, second, third and fourth pivot axes of rotation are cooperable to enable the user to collapse the height adjustable chair into a collapsed configuration for ease of transport and stowage. The height adjustable chair, as illustrated in connection with the alternative embodiment, may preferably comprise a series of steps for enabling the user to more readily access the first platform portion when the height adjustable chair is in an elevated configuration relative to the support surface. Further, to stabilize alternative embodiment, the invention contemplates an anterior-to-posterior leg assembly crossmember mechanism exemplified by strap-like elements for maintaining a fixed leg distance between the anterior leg assembly and the posterior leg assembly when in a user-support configuration.

BRIEF DESCRIPTION OF THE DRAWINGS

Other features and objectives of the invention will become more evident from a consideration of the following brief descriptions of patent drawings.

DETAILED DESCRIPTION OF THE PREFERRED EMBODIMENT

Figure 1:
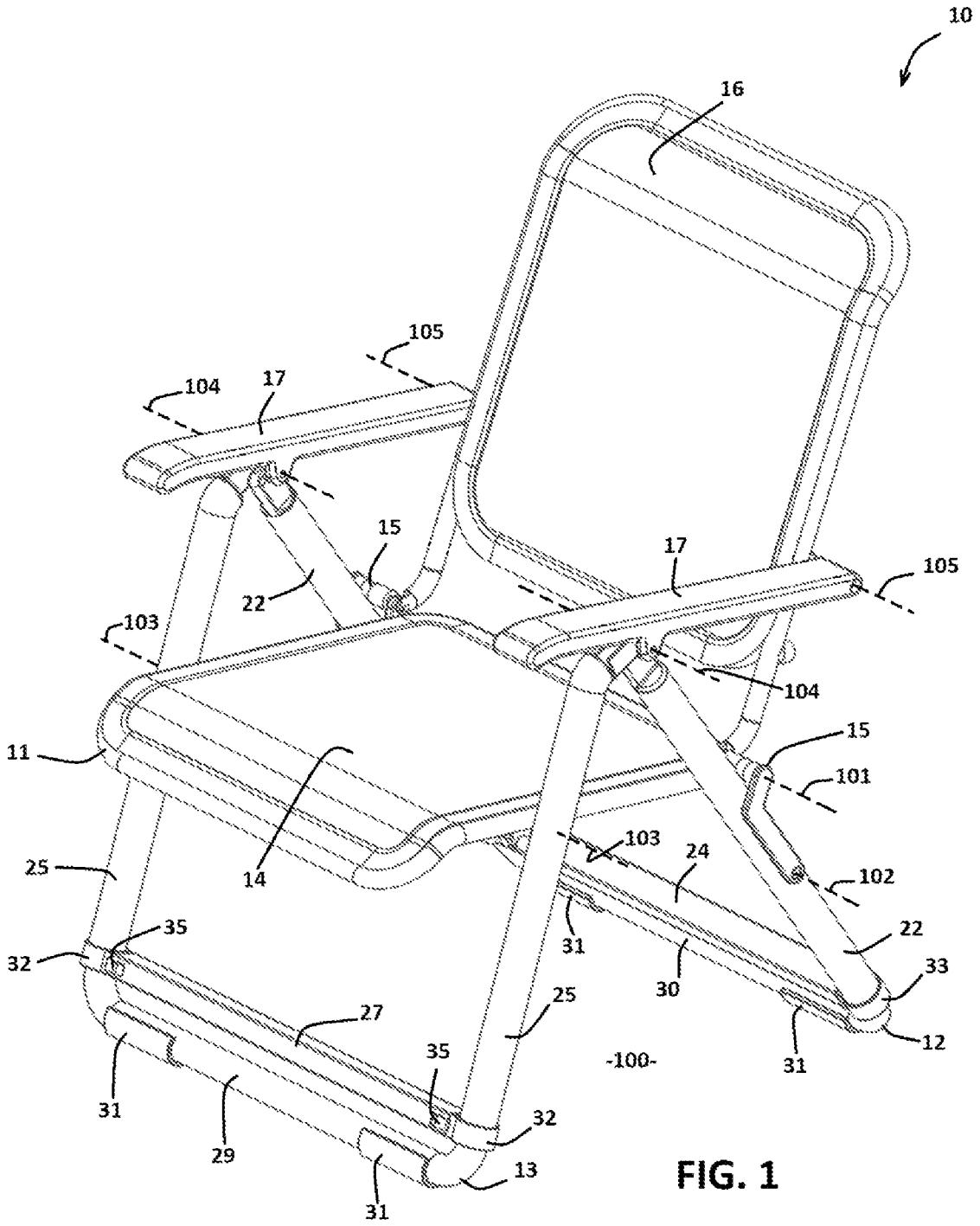
FIG. 1 is an anterior top perspective view of a first height adjustable chair apparatus according to the present invention shown in a minimized elevational height configuration.
Figure 2:
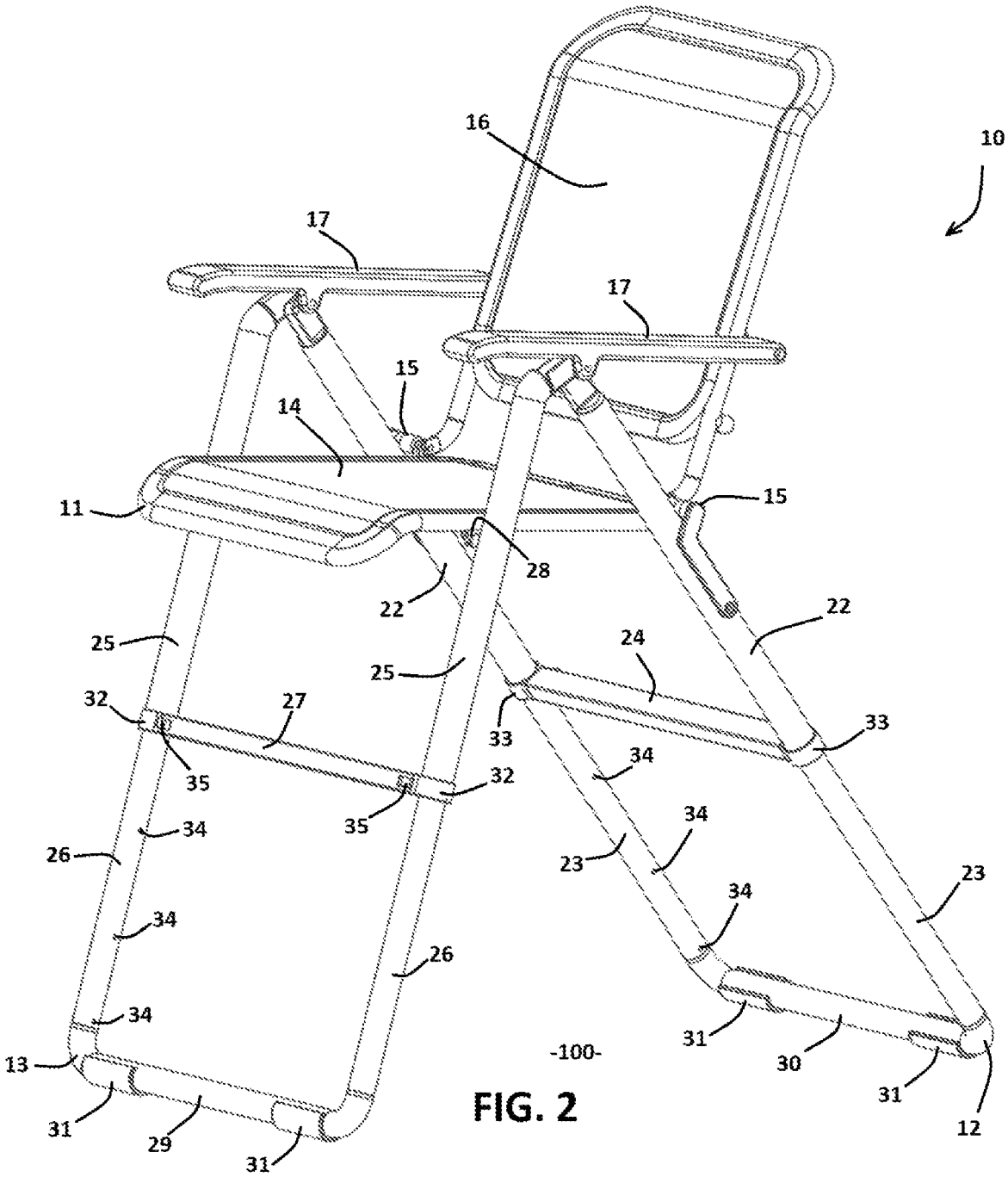
FIG. 2 is an anterior top perspective view of the first height adjustable chair apparatus according to the present invention shown in a maximized elevational height configuration.

Embodiments of systems, components, and methods of assembly and manufacture will now be described with reference to the accompanying figures. Although preferred and alternative embodiments, examples, and illustrations are disclosed below, it will be understood by those of ordinary skill in the art that the embodiments described herein extend beyond the specifically disclosed configurations, examples, and illustrations, and can include other users of the disclosure and obvious modifications and equivalents thereof. The terminology used in the descriptions presented herein is not intended to be interpreted in any limited or restrictive manner simply because it is being used in conjunction with a detailed description of certain specific embodiments of the disclosure. In addition, embodiments of the disclosure can comprise several novel features and no single feature is solely responsible for its desirable attributes or is essential to practicing any one of the several embodiments herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," "top," "bottom" and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specially mentioned above, derivatives thereof, and words of similar import.

Referring now the drawings with more specificity, the present invention essentially provides a first height adjustable chair apparatus as referenced at 10 in FIGS. 1-11 and a second height adjustable chair apparatus as referenced at 50 in FIGS. 12-16A. The first and second height adjustable chair apparatuses 10 and 50 enable a user to vary a select support height thereof so that the user may sit or support oneself at varying heights above a support surface as needed or desired.

The height adjustable chair apparatus 10 according to the present invention may be said to preferably comprise a user support platform assembly as at 11, a posterior leg assembly as at 12, and an anterior leg assembly as at 13. The user support platform assembly 11 preferably comprises a first platform portion or seat portion as at 14, a pair of pivot mechanisms as at 15, a second platform portion or back support portion as at 16, and laterally opposed third platform portions or armrest portions as at 17. The first support platform or seat platform 14 is configured to support a user as seated thereupon when in a user-supportive configuration as generally depicted in FIGS. 1, 2, and 8-11 with the second support platform or back support portion 16 providing rear support and the third support platforms or armrest portions 17 providing arm support.

Each of the pair of pivot mechanisms 15 preferably comprises an upper pivot axis, a lower pivot axis, a leg-bridge portion as at 18 extending in a first dimension through which the upper pivot axis axially extends; a bridge-to-arm portion or linkage as at 19 extending in a second dimension orthogonal to the first dimension; and a pivot arm portion 20 extending obliquely relative to the bridge-to-arm portion or linkage 19 in the second and a third dimension and through which the lower pivot axis orthogonally extends in parallel relation to the upper pivot axis.

The leg-bridge portions 18 bridge or span posterior sides of the laterally opposed upper posterior leg portions of the posterior leg assembly 12 and, when pivotally attached to the first platform portion 14, extend in, along, or about a first posterior pivot axis of rotation as at 101. The pair of pivot mechanisms 15 are firstly and pivotally attached to laterally opposed posterior portions 21 of the first platform portion 14. The upper pivot axes of the pair of pivot mechanisms 15 extend through the leg-bridge portions 18 are thereby axially aligned at the first platform portion 14 in, along or about the first posterior pivot axis of rotation 101.

The posterior leg assembly 12 preferably comprises laterally opposed upper posterior leg portions as at 22, laterally opposed lower posterior leg portions 23 extendable relative to the upper posterior leg portions 22, and a posterior locking mechanism as at 24 for locking the lower posterior leg portions 23 in extended relation relative to the upper posterior leg portions 22. The pair of pivot mechanisms 15 are secondly and pivotally attached to the upper posterior leg portions 22 and the lower pivot axes of the pair of pivot mechanisms 15 are thereby axially aligned at the upper posterior leg portions 22 orthogonally relative to the pivot arm portions 20 at a second posterior pivot axis of rotation as at 102.

The anterior leg assembly 13 preferably comprises laterally opposed upper anterior leg portions as at 25, laterally opposed lower anterior leg portions 26 extendable relative to the upper anterior leg portions 25, and an anterior locking mechanism 27 for locking the lower anterior leg portions 26 in extended relation relative to the upper anterior leg portions 25. The upper anterior leg portions 25 are pivotally attached to laterally opposed anterior portions 28 of the first platform portion 14 along a first anterior pivot axis of rotation as at 103. The anterior leg assembly 13 is further pivotally attached to the posterior leg assembly 12 at a second (leg-to-leg) anterior pivot axis of rotation as at 104.

In the preferred embodiment or height adjustable chair apparatus 10, the lower anterior leg portions 26 are telescopically receivable in and extendable from the upper anterior leg portions 25 and the lower posterior leg portions 23 are telescopically receivable in and extendable from the upper posterior leg portions 22. The anterior leg assembly 13 and the posterior leg assembly 12 together enable the user to particularly vary the height of the first support platform 14 relative to a support surface as at 100. The height adjustable chair apparatus 10 enables the user to vary a select support height thereof relative to the support surface 100 so that a user may adjust the height at which he or she sits upon the chair apparatus 10.

Recalling that the user support platform assembly 11 comprises second platform portion or back support portion 16, the reader will note the second platform portion 16 is preferably pivotally attached to the first platform portion 14 at the first posterior pivot axis of rotation 101. The laterally opposed third platform portions or arm rest portions 17 are preferably pivotally attached to laterally opposed pivot portions 36 of the second platform portion 16 along a third posterior pivot axis of rotation as at 105 and are further pivotally attached to the posterior leg assembly 12 and the anterior leg assembly 13 at the second anterior pivot axis of rotation 104.

Figure 3:
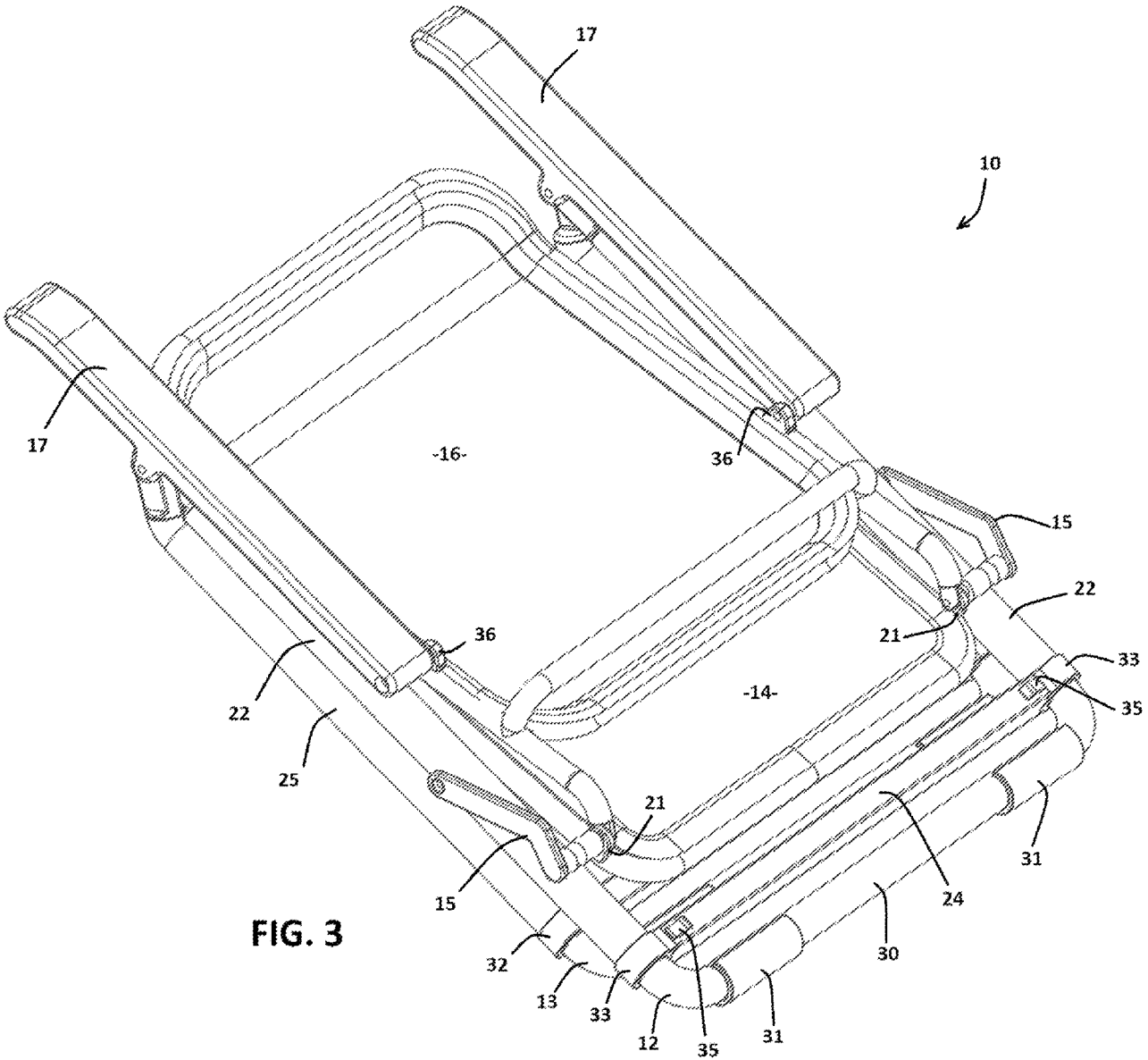
FIG. 3 is a first perspective view of the first height adjustable chair apparatus according to the present invention shown in folded, collapsed configuration for portability or stowage.
Figure 4:
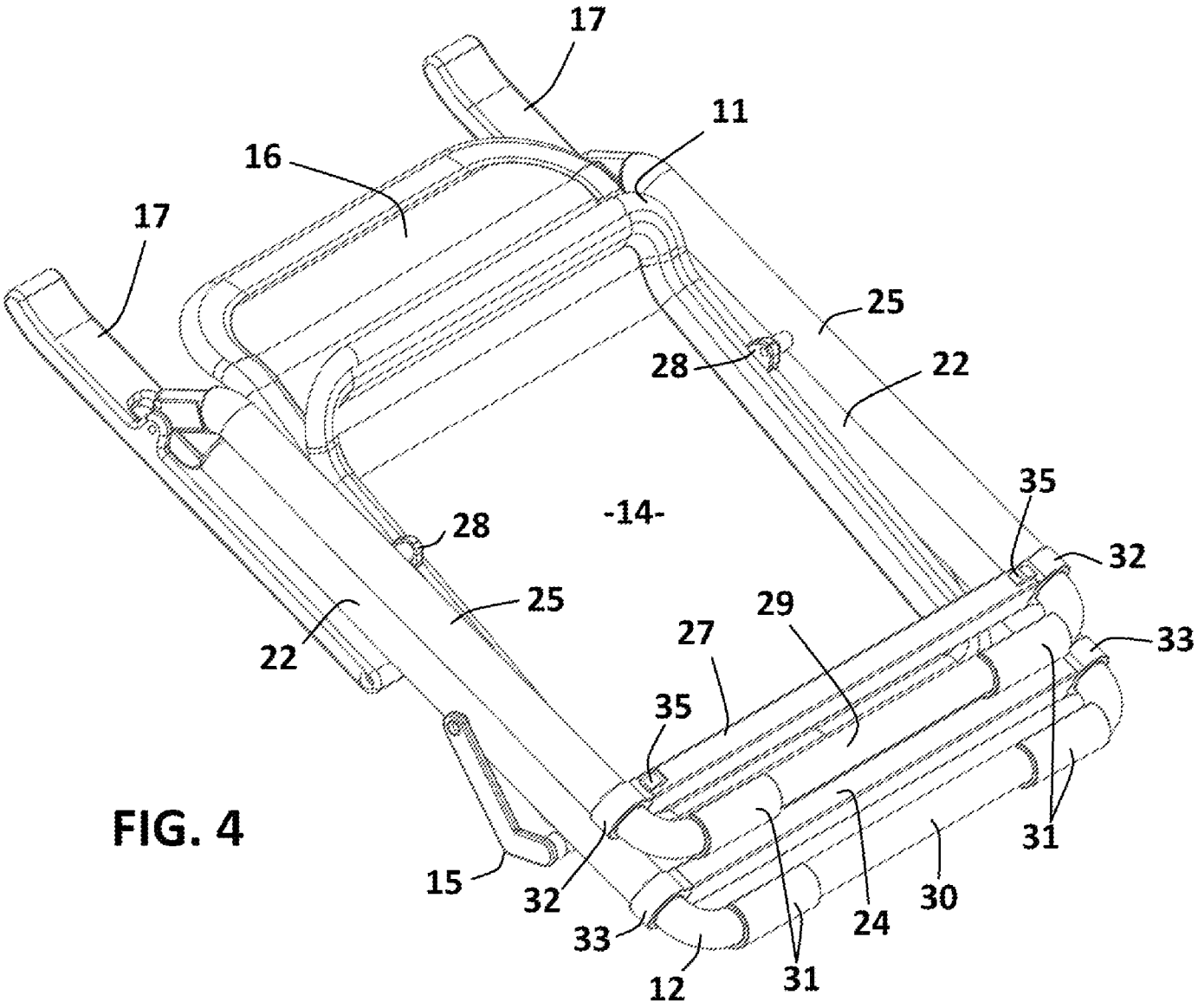
FIG. 4 is a second perspective view of the first height adjustable chair apparatus according to the present invention shown in folded, collapsed configuration for portability or stowage.
Figure 5:
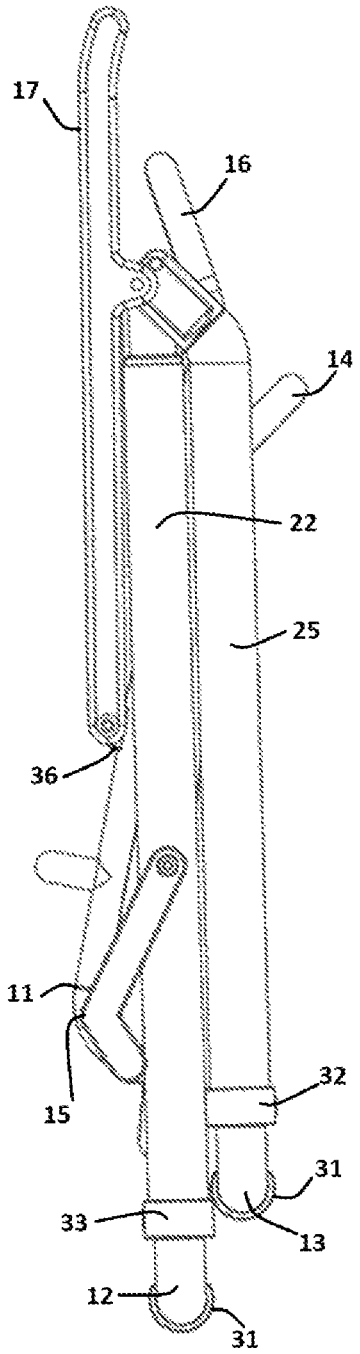
FIG. 5 is a lateral edge view of the first height adjustable chair apparatus according to the present invention shown in folded, collapsed configuration for portability or stowage.
Figure 6:
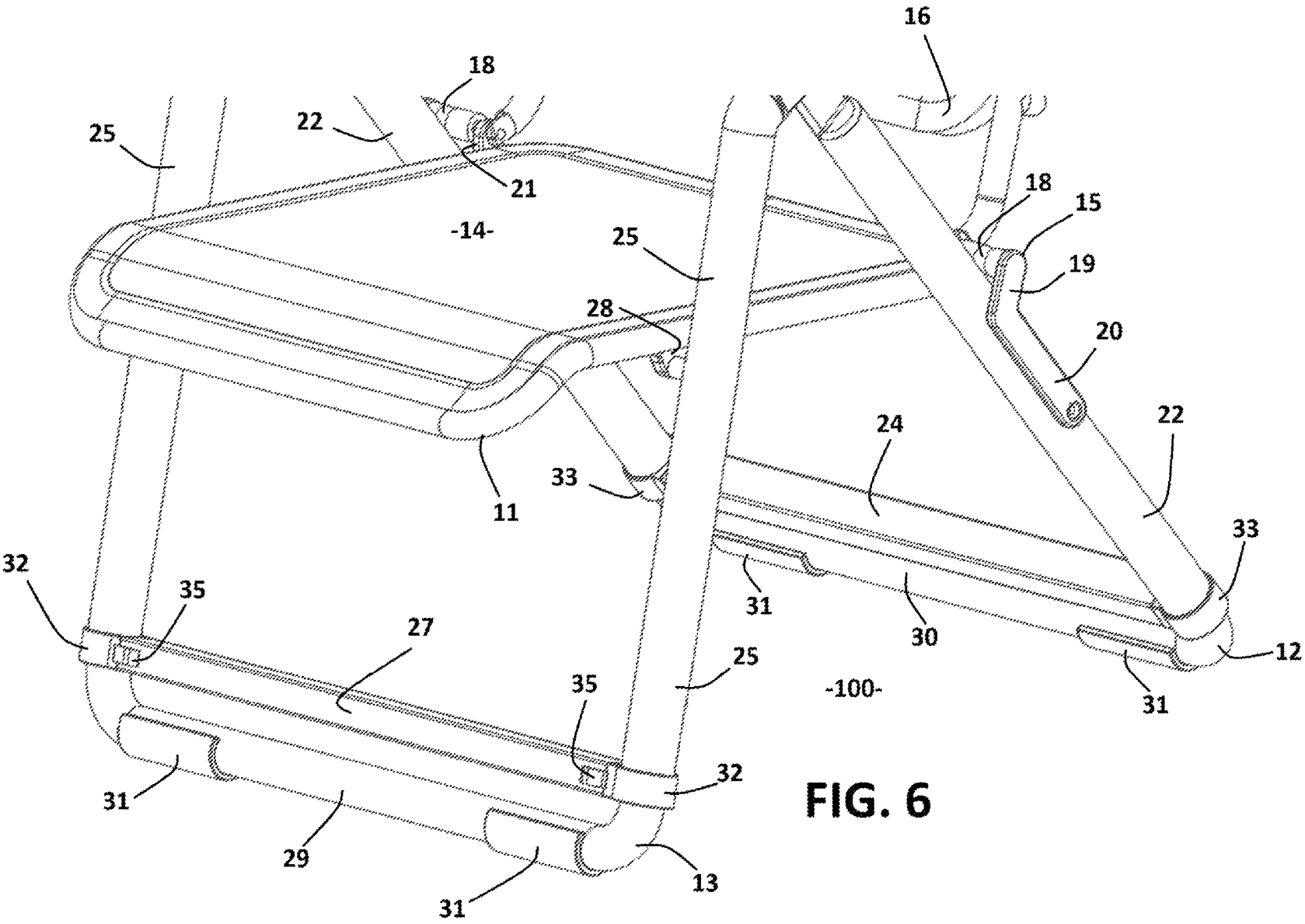
FIG. 6 is an enlarged fragmentary perspective depiction of the anterior and posterior leg assemblies of the first height adjustable chair apparatus according to the present invention shown in the minimized elevational height configuration.
Figure 7:
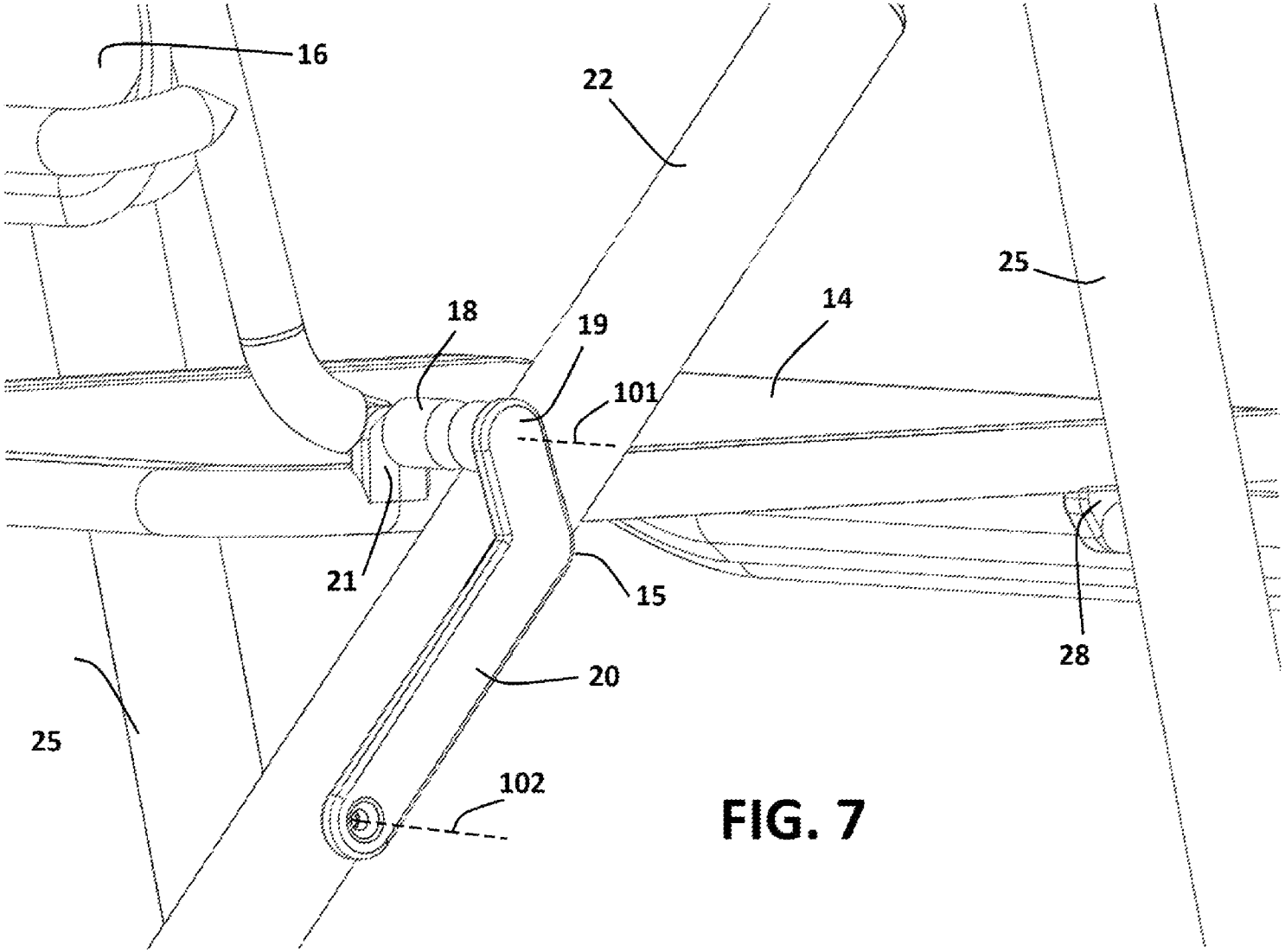
FIG. 7 is an enlarged fragmentary perspective depiction of a pivot mechanism pivotally connecting a first portion of the posterior leg assembly to a first platform or seat portion of the first height adjustable chair apparatus according to the present invention.

The height adjustable chair apparatus 10 according to the present invention may be reconfigured or folded into a collapsed configuration for ease of transport or portability and storage as generally depicted in FIGS. 3-5. In this regard, the first, second, and third posterior pivot axes 101, 102, and 105 are cooperable with the first and second anterior pivot axes 103 and 104 and the structures interconnected thereby to enable the user to collapse or fold the height adjustable chair apparatus 10 into a collapsed configuration for ease of transport or portability and/or storage.

The anterior leg assembly 13 preferably further comprises an anterior crossmember as at 29 and the posterior leg assembly 12 preferably further comprises a posterior crossmember as at 30. The anterior crossmember 29 extends intermediate the lower anterior leg portions 26 interconnecting the lower anterior leg portions 26 thereby maintaining a fixed first anterior distance between and stabilizing the lower anterior leg portions 26. The posterior crossmember 30 extends intermediate the lower posterior leg portions 23 interconnecting the lower posterior leg portions 23 thereby maintaining a fixed first posterior distance between and stabilizing the lower posterior leg portions 23. The anterior crossmember 29 and the posterior crossmember 30 may be preferably outfitted with feet elements 31 preferably formed from a resilient, high friction material exemplified by rubber to prevent movement of the outfitted features relative to the support surface 100.

The anterior locking mechanism 27 may be preferably integrated with a crossbar element that extends intermediate and interconnects lower anterior portions 32 of the upper anterior leg portions 25 and the posterior locking mechanism 24 may be preferably integrated with a crossbar element that extends intermediate and interconnects lower posterior portions 33 of the upper posterior leg portions 22. The anterior locking mechanism 27 is preferably outfitted with laterally opposed spring-biased pin mechanisms 35 (pins not specifically illustrated) which cooperate with pin-receiving apertures 34 formed in the lower anterior leg portions 26. The laterally opposed spring-biased pin mechanisms 35 are cooperable with the series of pin-receiving apertures 34 for enabling the user to selectively lock the lower anterior leg portions 26 in a telescopically extended state relative to the upper anterior leg portions 25.

The posterior locking mechanism 24 is also preferably outfitted with laterally opposed spring-biased pin mechanisms 35 which cooperate with pin-receiving apertures 34 formed in the lower posterior leg portions 23. The laterally opposed spring-biased pin mechanisms 35 are cooperable with the series of pin-receiving apertures 34 formed in the lower posterior leg portions 23 for enabling the user to selectively lock the lower posterior leg portions 23 in a telescopically extended state relative to the upper posterior leg portions 22. The anterior locking mechanism 27 with integrated crossbar element further maintains a fixed second anterior distance between and stabilizes the upper anterior leg portions 25 at the lower anterior portions 32. Similarly, the posterior locking mechanism 24 with integrated crossbar element maintains a fixed second posterior distance between and stabilizes the upper posterior leg portions 22 at lower posterior portions 33.

The anterior leg assembly 13 is substantially planar and thus preferably extends in an anterior leg plane 106. Similarly, the posterior leg assembly 12 is also substantially planar and preferably extends in a posterior leg plane 107. When the height adjustable chair apparatus 10 is in a user-support configuration as generally and comparatively depicted in FIGS. 1, 2, and 8-11, the anterior leg plane 106 is preferably angled relative to the posterior leg plane 107 at a select oblique angle 108, which select oblique angle 108 is preferably between 50 and 55 degrees. Excellent results have been achieved with a select oblique angle 108 of between 50 and 55 degrees for structurally cooperating with the anterior leg assembly 13 and the posterior leg assembly 12 during elevation of the user platform assembly 11 so as to provide a limited vertical first support platform height to horizontal leg span ratio range.

Referencing FIGS. 8-11, the reader will there consider a variable height or anterior distance 109 as measured between the first platform portion 14 to a lower portion of the lower anterior leg portions 26 at the anterior crossmember 29. The anterior distance or variable height 109 provides a first quotient value. A variable support surface span distance as at 110 extends between a lower portion of the lower anterior leg portions 26 to a lower portion of the lower posterior leg portions 23. The variable support surface span distance 110 provides a second quotient value.

Figure 8:
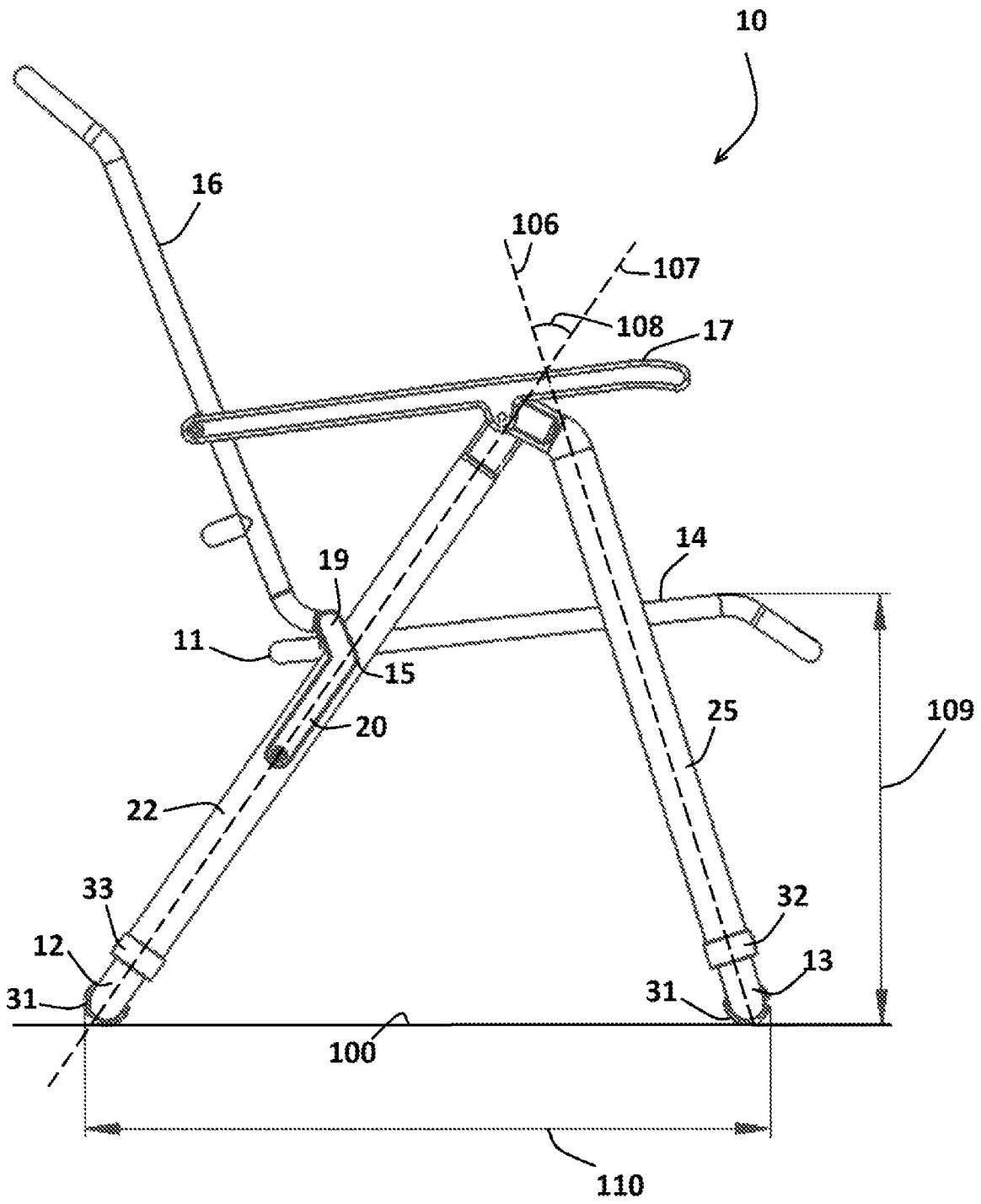
FIG. 8 is a first sequential elevational side view of the first height adjustable chair apparatus according to the present invention shown in the minimized elevational height configuration.
Figure 9:
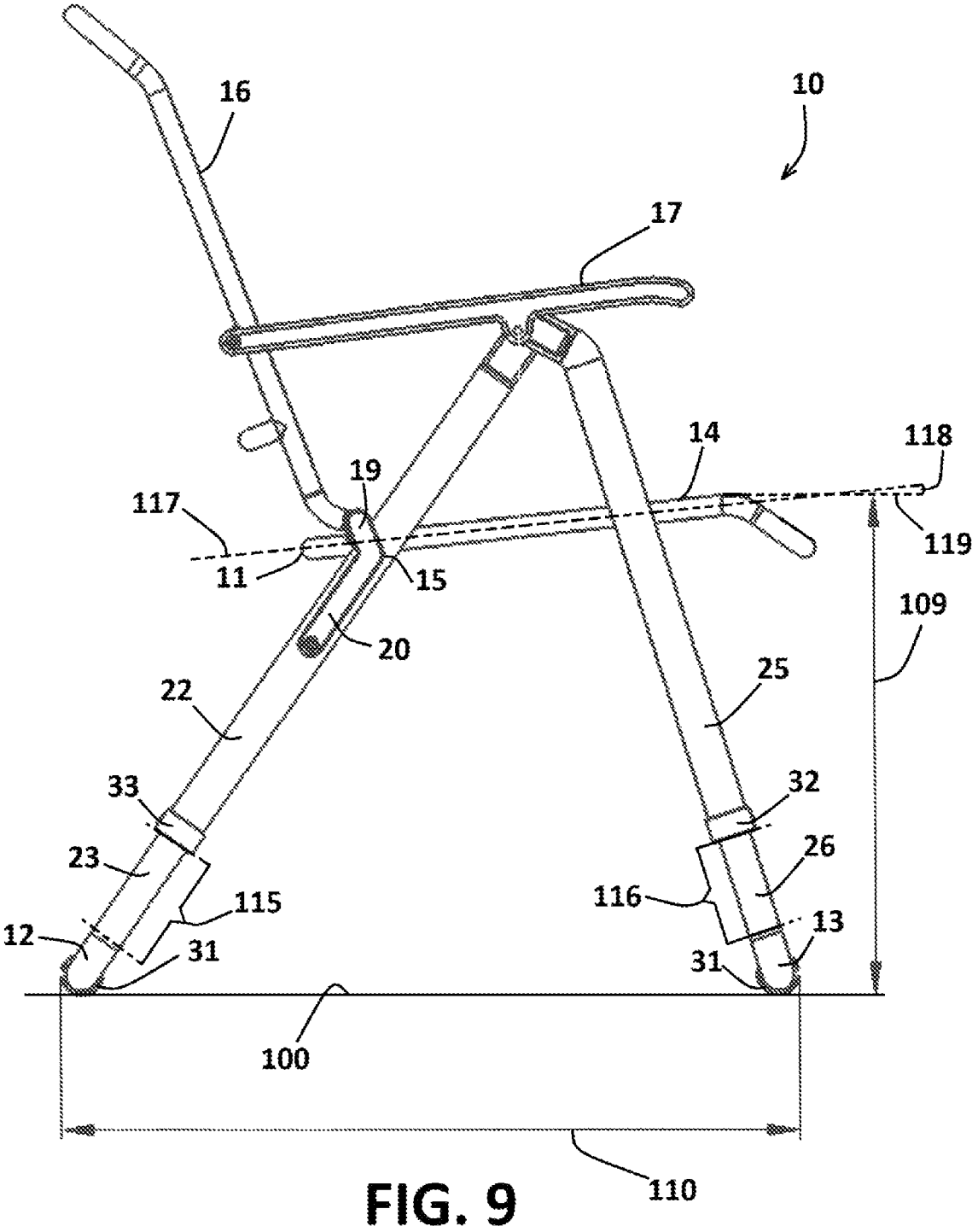
FIG. 9 is a second sequential elevational side view of the first height adjustable chair apparatus according to the present invention shown in a first elevational height configuration.
Figure 10:
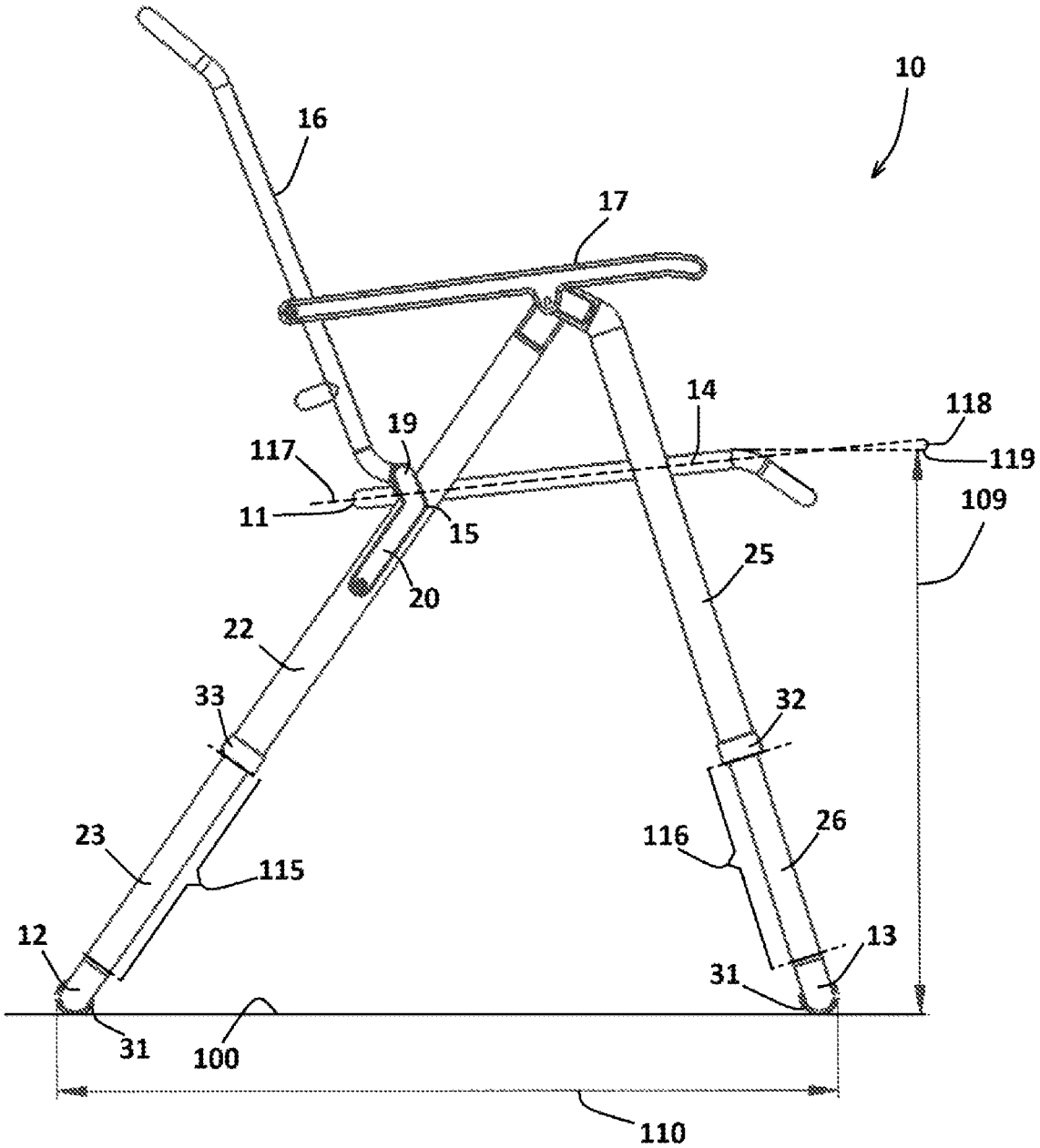
FIG. 10 is a third sequential elevational side view of the first height adjustable chair apparatus according to the present invention shown in a second elevational height configuration.
Figure 11:
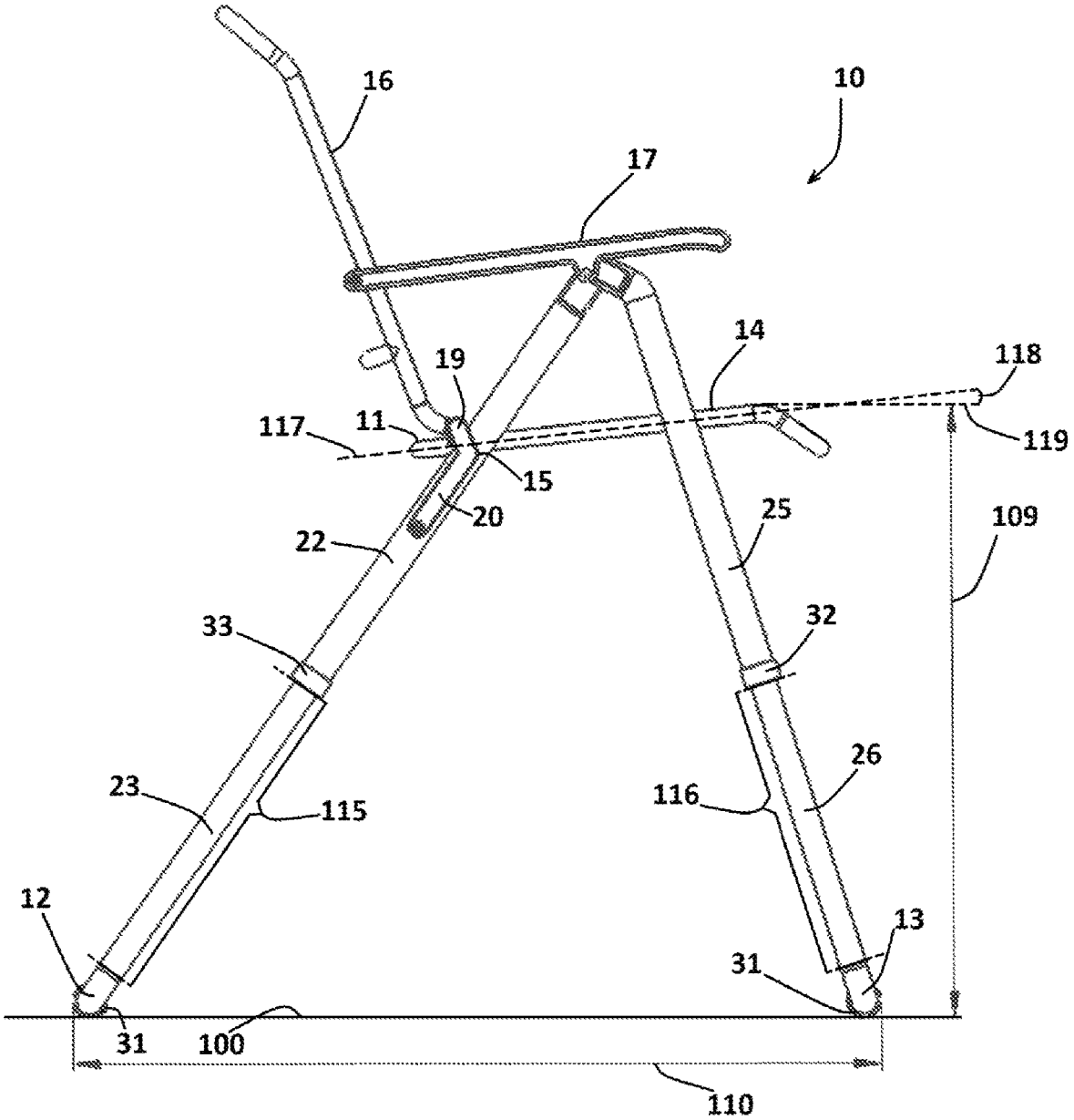
FIG. 11 is a fourth sequential elevational side view of the first height adjustable chair apparatus according to the present invention shown in the maximum elevational height configuration.
Figure 12:
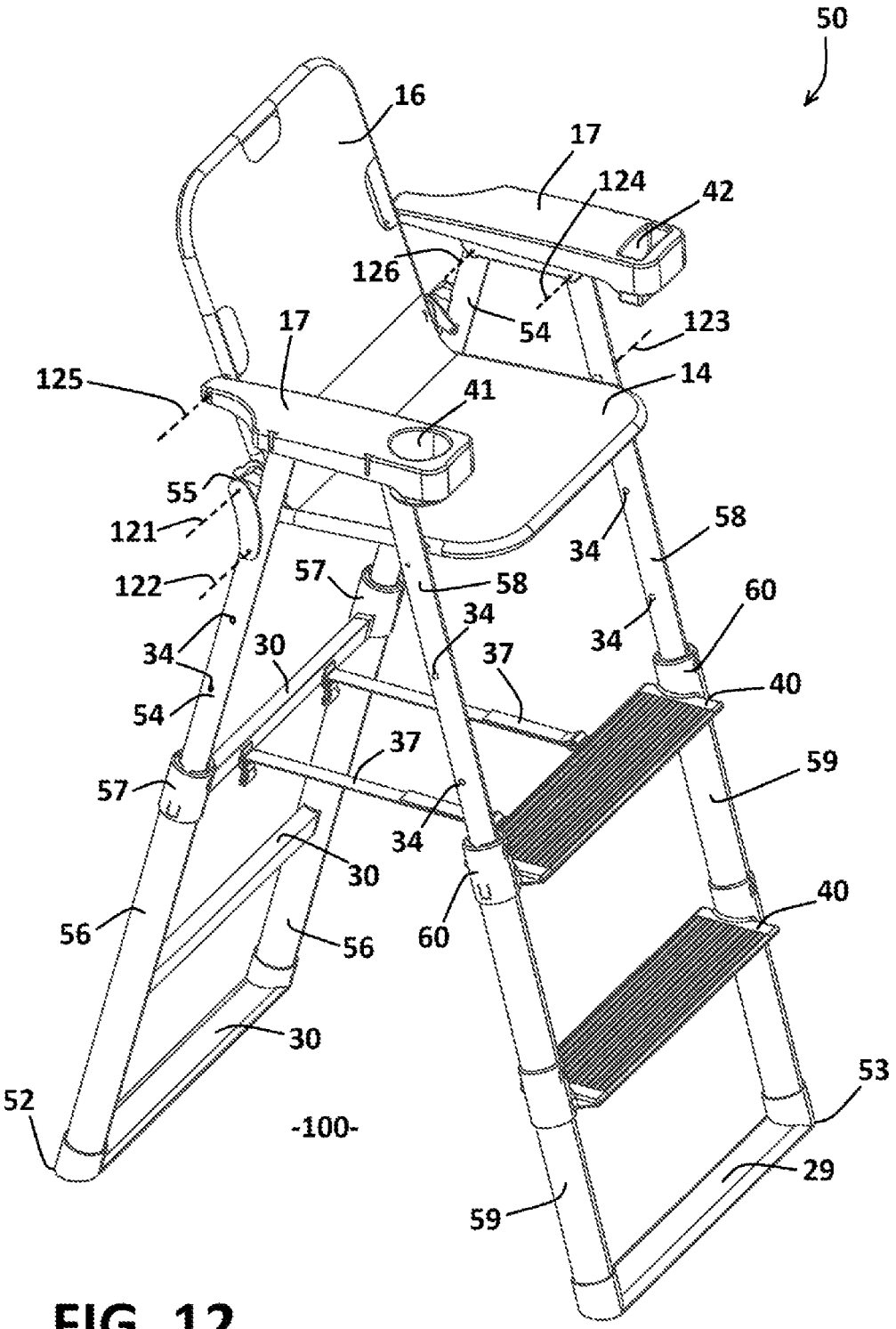
FIG. 12 is a first top perspective view of a second height adjustable chair apparatus according to the present invention.
Figure 13:
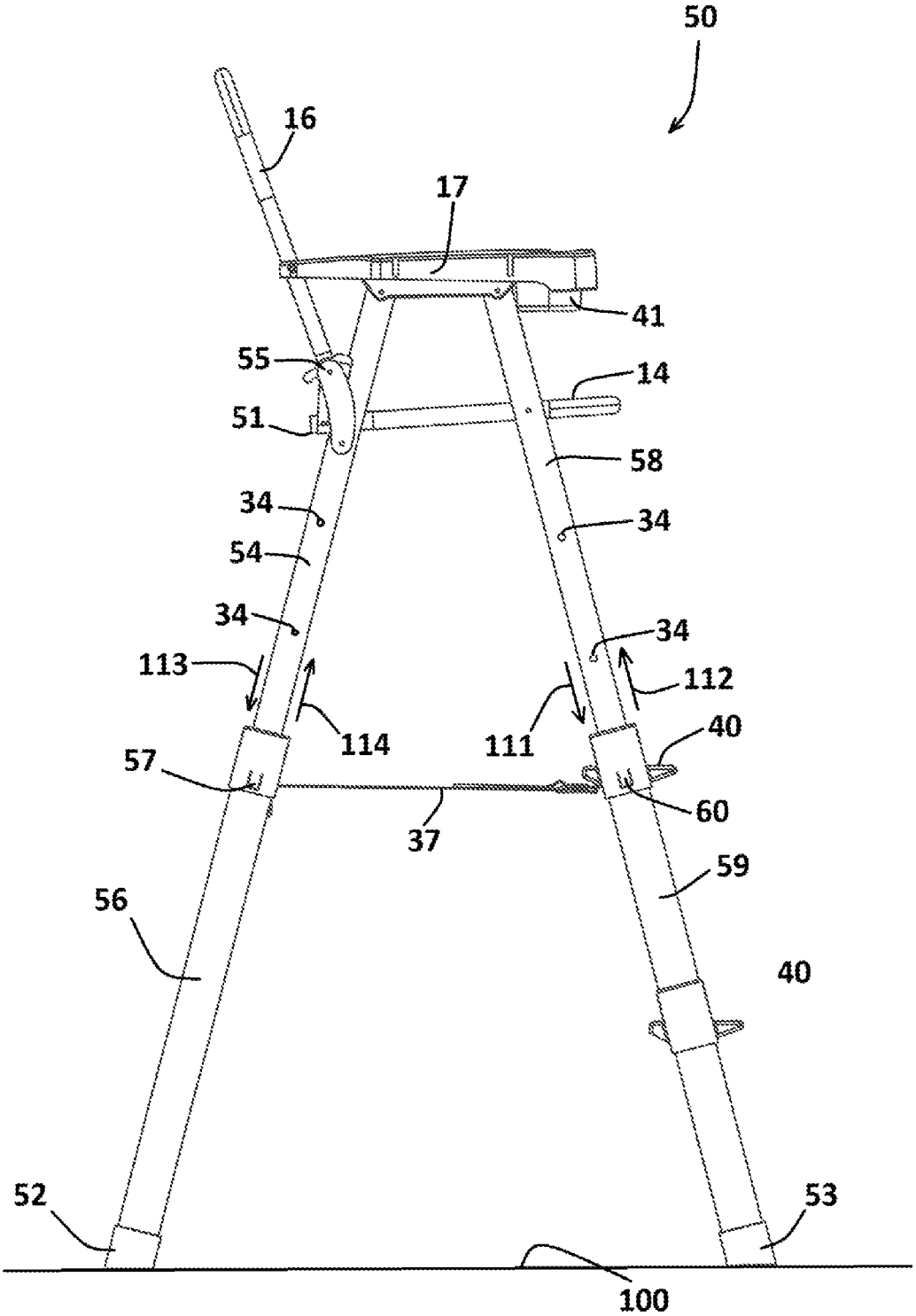
FIG. 13 is a first elevational side view of the second height adjustable chair apparatus according to the present invention.
Figure 14:
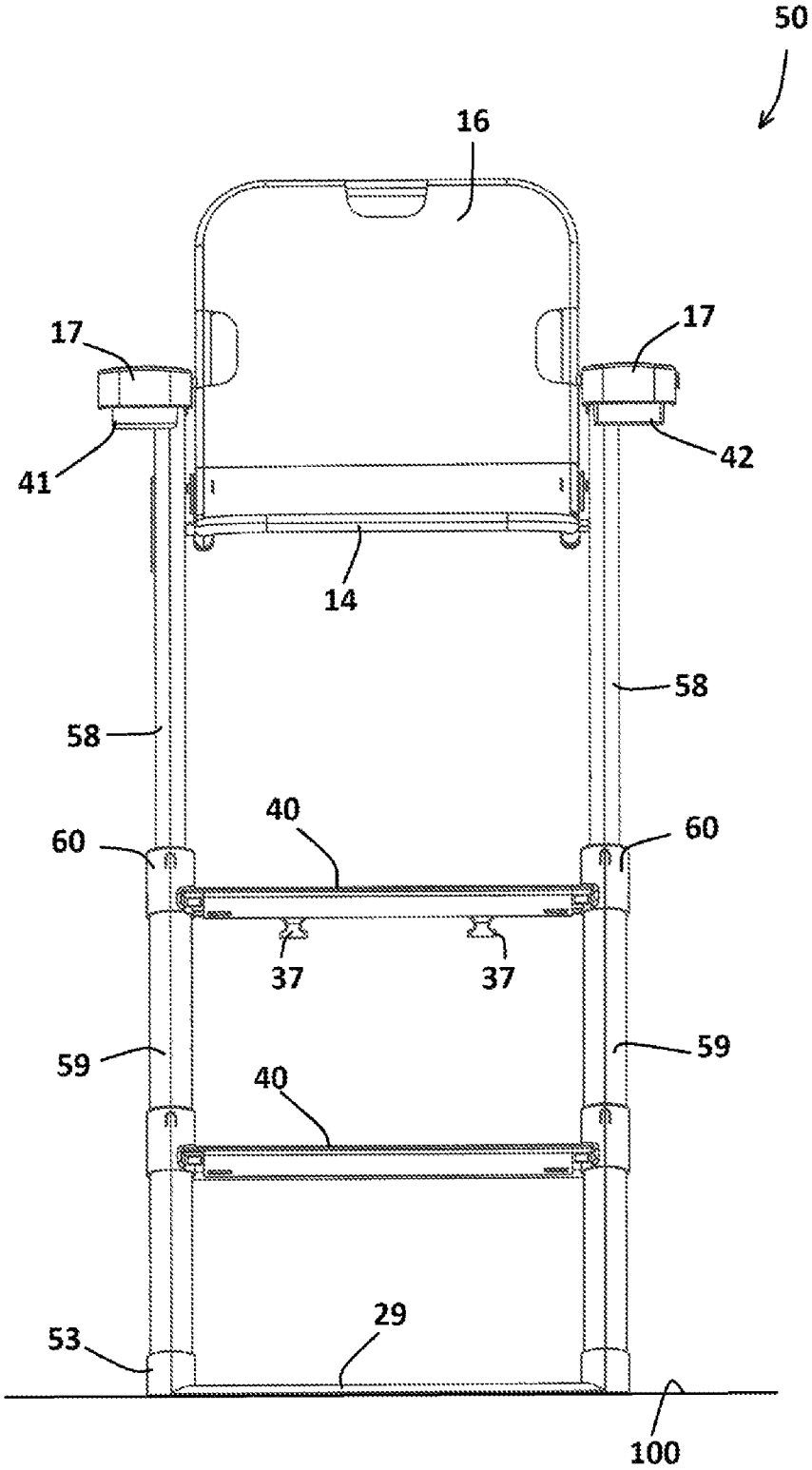
FIG. 14 is a first elevational front or anterior view of the second height adjustable chair apparatus according to the present invention.
Figure 14A:
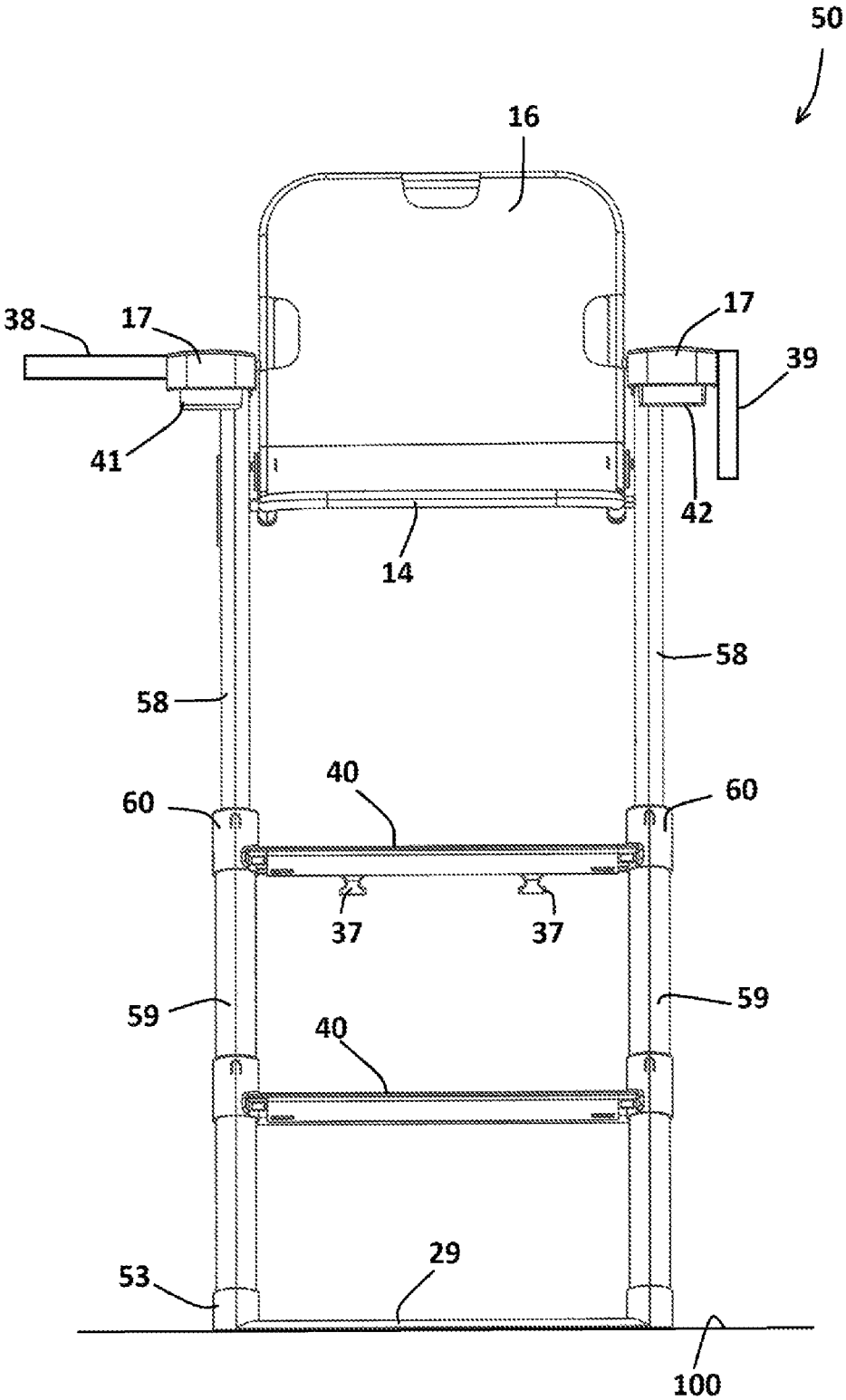
FIG. 14A is a second elevational front or anterior view of the second height adjustable chair apparatus according to the present invention shown outfitted with optional attachment features at the armrest portions.
Figure 15:
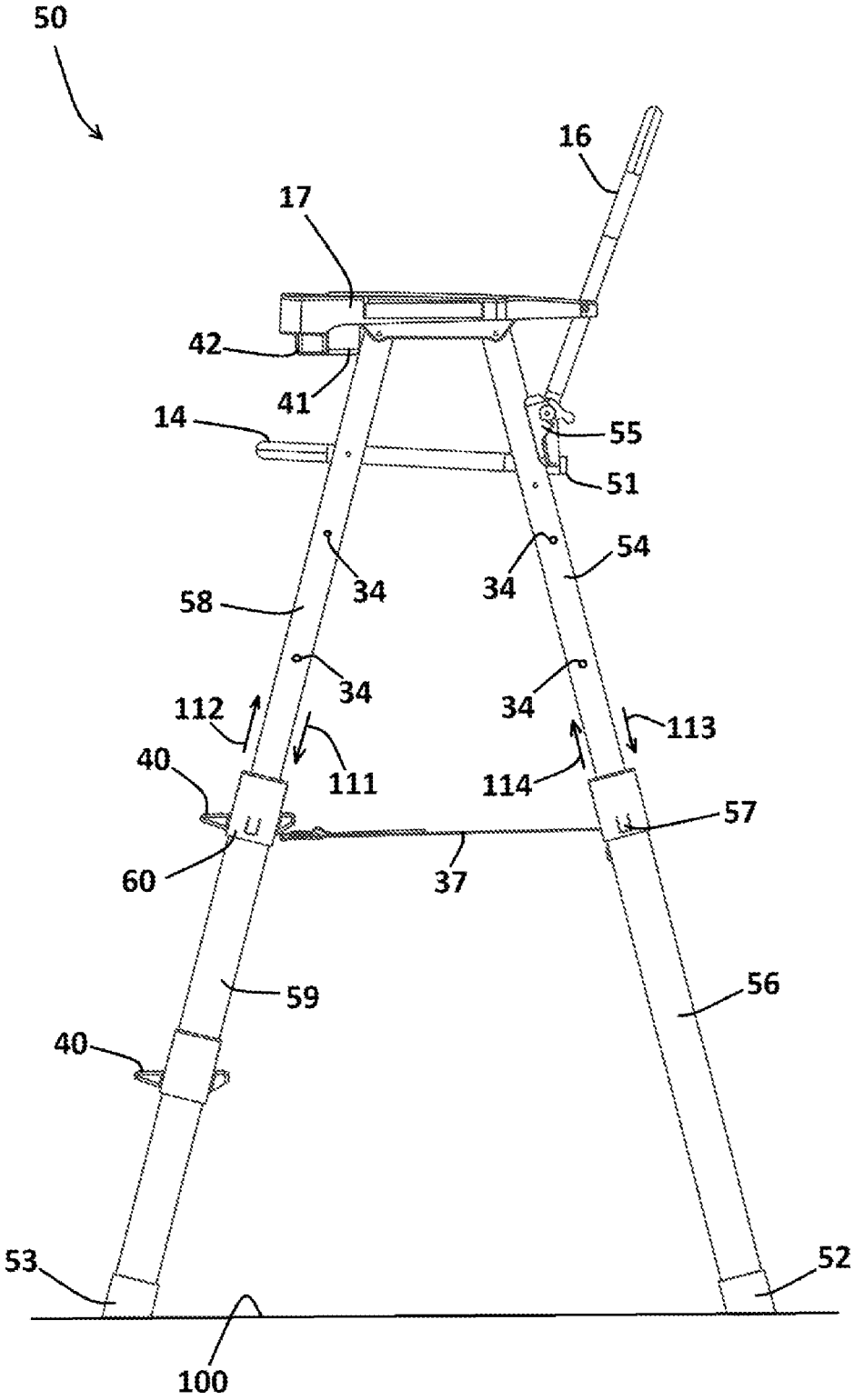
FIG. 15 is a second elevational side view of the second height adjustable chair apparatus according to the present invention.
Figure 16:
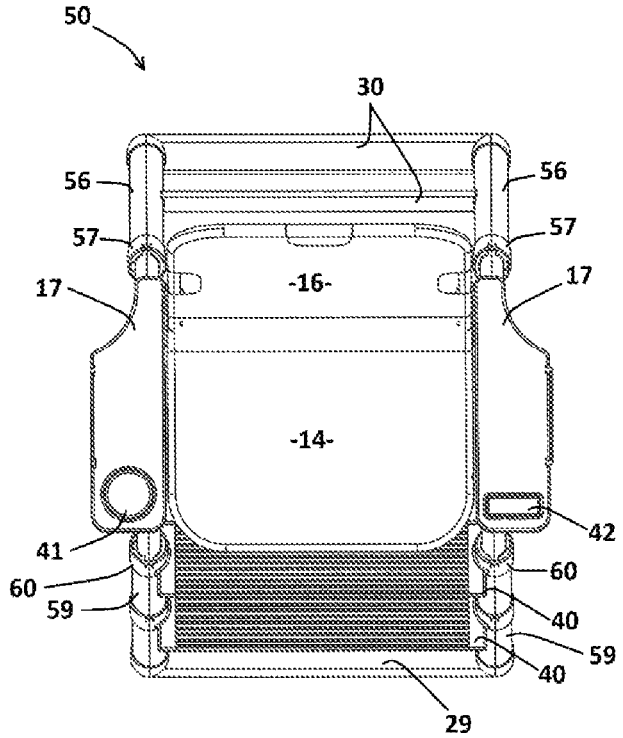
FIG. 16 is a first top plan view of the second height adjustable chair apparatus according to the present invention.
Figure 16A:
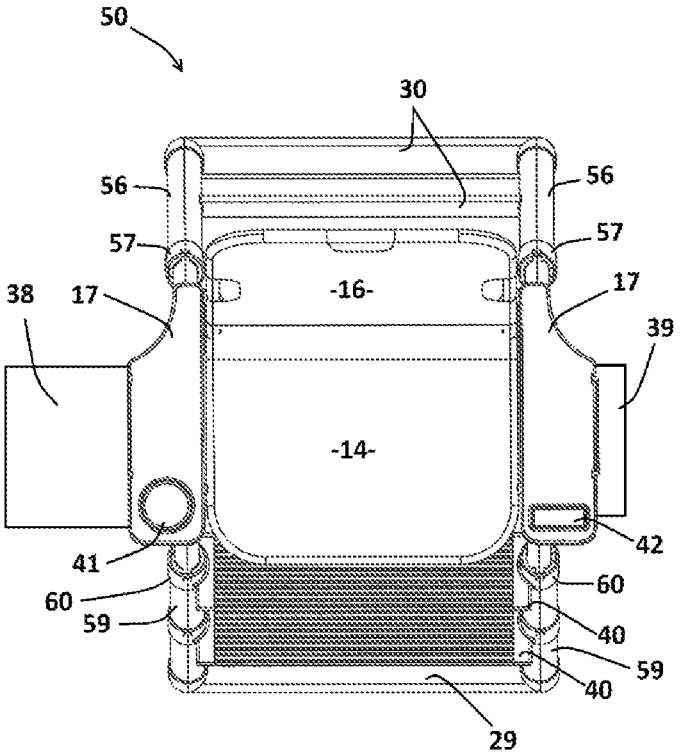
FIG. 16A is a second top plan view of the second height adjustable chair apparatus according to the present invention shown outfitted with optional attachment features at the armrest portions.

The height-to-leg span ratio derived from the first quotient value of the variable vertical height or anterior distance 109 to the second quotient value of variable support surface span distance 110 is preferably between 0.60 when in a minimum height configuration as generally depicted in FIG. 8 and 0.75 when in a maximum height configuration as generally depicted in FIG. 11. The height-to-leg span ratio is on the order of 0.67 in FIG. 9 and the height-to-leg span ratio is on the order of 0.72 in FIG. 10.

The first support platform 14 extends in a support plane as at 117 when the height adjustable chair 10 is supported by a support surface as at 100, which support surface 100 is substantially parallel to the plane 119 defining the upper limit of the variable height or anterior distance 109. The first support platform 14 supports a user thereupon in elevated relation relative to the support surface 100, and the support plane 117 extends in a select oblique angle relative to the support surface 100 as generally depicted and referenced at oblique angle 118.

The laterally opposed lower posterior leg portions 23 are configured to extend incrementally relative to the upper posterior leg portions 22, and the laterally opposed lower anterior leg portions 26 are configured to extend incrementally relative to the upper anterior leg portions 25. The posterior incremental extensions 115 of the laterally opposed lower posterior leg portions 23 are greater in length or are relatively longer than the anterior incremental extensions 116 of laterally opposed lower anterior leg portions 26. The difference in length of the incremental extensions 115 and the incremental extensions 116 maintains the select oblique angle 118 as the user varies the height of the first support platform 14 relative to the support surface 100.

Recalling the variable height or anterior distance 109 between the first platform portion 14 and the first lower portion of the lower anterior leg portions 26 provides a first quotient value, and the horizontal distance or variable support surface span distance 110 between the second lower portion of the lower anterior leg portions 26 to first lower portion of the lower posterior leg portions 23 provides a second quotient value. The ratio of the first quotient value to the second quotient value is between 0.60 when in a minimum chair height configuration as depicted in FIG. 8, and 0.75 when in a maximum chair height configuration as depicted in FIG. 11. The differing lengths of the posterior incremental extensions 115 and the anterior incremental extensions 116 maintain the select oblique angle 118 and support this ratio as the user varies the height of the first support platform 14 relative to the support surface 104.

Referring now more particularly to the height adjustable chair apparatus 50 according to the present invention, the same may be said to preferably comprise a user support platform assembly as at 51, a posterior leg assembly as at 52, and an anterior leg assembly as at 53. The user support platform assembly 51 preferably comprises a first platform portion or seat portion as at 14, a pair of pivot mechanisms as at 55, a second platform portion or back support portion as at 16, and laterally opposed third platform portions or arm rest portions as at 17.

The posterior leg assembly 52 preferably comprises laterally opposed upper posterior leg portions as at 54, laterally opposed lower posterior leg portions 56, and at least one posterior locking mechanism as at 57 for locking the lower posterior leg portions 56 in extended relation relative to the upper posterior leg portions 54. The upper posterior leg portions 54 are preferably extendable relative to the lower posterior leg portions 56 although the reader will note the key structural feature is extendibility of opposed leg portions relative to one another.

Each of the pair of pivot mechanisms 55 preferably comprises first and second pivot axes. The pivot mechanisms 55 are firstly pivotally attached to laterally opposed posterior portions of the first platform portion 14, and the first pivot axes of the pair of pivot mechanisms 55 extend in, along, or about a first pivot axis of rotation as at 121. The pair of pivot mechanisms 55 are secondly and pivotally attached to the upper posterior leg portions 54 and the second pivot axes of the pair of pivot mechanisms 55 are thereby axially aligned at the upper posterior leg portions 54 at a second pivot axis of rotation as at 122.

The anterior leg assembly 53 preferably comprises laterally opposed upper anterior leg portions as at 58, laterally opposed lower anterior leg portions 59, and at least one anterior locking mechanism 60 for locking the lower anterior leg portions 59 in extended relation relative to the upper anterior leg portions 58. The upper anterior leg portions 58 are preferably extendable relative to the lower anterior leg portions 59, although the reader will note the key structural feature is extendibility of opposed leg portions relative to one another.

In other words, in the alternative embodiment or height adjustable chair apparatus 50, the upper anterior leg portions 58 are telescopically receivable in (as at arrow 111) and extendable from (as at arrow 112) the lower anterior leg portions 59 and the upper posterior leg portions 54 are telescopically receivable in (as at arrow 113) and extendable from (as at arrow 114) the lower posterior leg portions 56 as generally depicted in Figure Nos 13 and 15. The upper anterior leg portions 58 are pivotally attached to laterally opposed anterior portions of the first platform portion 14 along a third pivot axis of rotation as at 123. The anterior leg assembly 53 is further pivotally attached to the armrests or third platform portions 17 at a fourth pivot axis of rotation as at 124.

The first support platform or seat platform 14 is configured to support a user as seated thereupon when in a user-supportive configuration as generally depicted in FIGS. 12-16A with the second support platform or back support portion 16 providing rear support and the third support platforms or armrest portions 17 providing arm support. The anterior leg assembly 53 and the posterior leg assembly 52 together enable the user to particularly vary the height of the first support platform 14 relative to a support surface as at 100. The height adjustable chair apparatus 50 enables the user to vary a select support height thereof relative to the support surface 100 so that a user may adjust the height at which he or she sits.

Recalling that the user support platform assembly 11 comprises second platform portion or back support portion 16, the reader will note the second platform portion 16 is preferably pivotally attached to the first platform portion 14 at the first pivot axis of rotation 121. The laterally opposed third platform portions or arm rest portions 17 are preferably pivotally attached to laterally opposed pivot portions of the second platform portion 16 along a fifth pivot axis of rotation as at 125 and are further pivotally attached to the posterior leg assembly 52 at a sixth pivot axis of rotation 126.

Similar to the height adjustable chair apparatus 10, the height adjustable chair apparatus 50 according to the present invention may be reconfigured or folded into a collapsed configuration for ease of transport or portability and storage. In this regard, the series of pivot axes of rotation (e.g. pivot axes 121, 122, 123, 124, 125, and 126) are cooperable with one another and the structures interconnected thereby to enable the user to collapse or fold the height adjustable chair apparatus 50 into a collapsed configuration for ease of transport or portability and/or storage.

The anterior leg assembly 53 preferably further comprises at least one anterior crossmember as at 29 and the posterior leg assembly 52 preferably further comprises at least one posterior crossmember as at 30. The at least one anterior crossmember 29 preferably extends intermediate the lower anterior leg portions 59 interconnecting the lower anterior leg portions 59 thereby maintaining a fixed distance between and stabilizing the lower anterior leg portions 59.

The posterior crossmember(s) 30 extend intermediate the lower posterior leg portions 56 interconnecting the lower posterior leg portions 56 thereby maintaining a fixed distance between and stabilizing the lower posterior leg portions 56. The lowermost anterior crossmember 29 and the lowermost posterior crossmember 30 may be preferably outfitted with a resilient, high friction material exemplified by rubber to prevent movement of the outfitted features relative to the support surface 100.

The anterior locking mechanism(s) 60 are preferably outfitted with spring-biased pin mechanisms (pins not specifically illustrated) which cooperate with pin-receiving apertures 34 formed in the upper anterior leg portions 58. The spring-biased pin mechanisms are cooperable with the series of pin-receiving apertures 34 for enabling the user to selectively lock the upper anterior leg portions 58 in a telescopically extended state relative to the lower anterior leg portions 59.

The posterior locking mechanism(s) 57 are also preferably outfitted with spring-biased pin mechanisms which cooperate with pin-receiving apertures formed in the upper posterior leg portions 54. The spring-biased pin mechanisms 57 are cooperable with the series of pin-receiving apertures 34 formed in the upper posterior leg portions 54 for enabling the user to selectively lock the upper posterior leg portions 54 in a telescopically extended state relative to the lower posterior leg portions 56.

A select leg assembly exemplified by the anterior leg assembly 53 in the drawings, but selected from the group consisting of the anterior leg assemblies 13/53 and the posterior leg assemblies 12/52, may preferably comprise a series of steps as at 40 that traverse along the width of the select leg assembly as exemplified by the anterior leg assembly 53 to provide ability for the user to mount the seat portion or first platform portion 14 when the height adjustable chair apparatuses 10 and/or 50 are in a position of raised height as generally depicted in FIGS. 12-16A in connection with the height adjustable chair apparatus 50. Steps 40 further function as crossmember mechanisms to maintain the distance between opposed leg portions and increase the stability thereof.

In other words, the steps 40 enable the user to more readily access the first platform portion 14 when the height adjustable chair apparatuses 10 or 50 are in an elevated configuration relative to the support surface 100. Further, the height adjustable chair apparatuses 10 or 50 according to the present invention may preferably comprise an anterior-to-posterior leg assembly crossmember mechanism as illustrated in connection with height adjustable chair apparatus 50 in FIGS. 12-15. The anterior-to-posterior leg assembly crossmember mechanism may preferably comprise a pair of parallel strap-like crossmembers 37 for maintaining a fixed leg distance between the anterior leg assembly 13/53 and the posterior leg assembly 12/52 and stabilizing the same when in a user-support configuration.

The alternative embodiments of the height adjustable chair apparatus 50 according to the present invention shown in FIGS. 12-16A are believed to be substantially the same as the height adjustable chair apparatus 10 according to the present invention. The embodiment there depicted preferably comprises a seat portion or first platform portion 14, a pair of leg assemblies as at anterior leg assembly 53 and posterior leg assembly 52. The anterior leg assembly 53 and the posterior leg assembly 52 are each pivotally attached to the first platform portion 14, but are separately pivotally attached to the arm rest portions or third platform portions 17 at anterior and posterior pivot attachment points coaxial with pivot axes 124 and 126 instead of singular pivot attachment point as in height adjustable chair apparatus 10.

The proximal portions of the anterior and posterior leg assemblies 53/52 also feature an expansion and contraction mechanism, preferably in the form of telescoping tubular leg sections (formed of substantially rigid weight-supportive material) or similar other structural features, which allow for a lengthening or shortening of the leg assemblies 53/52 to provide the ability for adjusting the overall height of the height adjustable chair apparatus 50. Other features of the height adjustable chair apparatuses 10/50 include a back support or second platform portion 16; first and second armrest portions or third platform portions 17.

These armrests or third platform portions 17 can be additionally supplemented with convenience features for the user such a fold-out tray as at 38 and/or a pouch assembly as at 39 and/or a cup holder as at 41 and/or a pocket formation 42 for holding personal items. Additional possible features of the chair can also include a solar panel to be located on some portion of the height adjustable chair apparatus 10 or 50. The solar panel provides a power source for the at least one power outlet provided on the chair (not specifically illustrated).

The pivot attachment points between the leg assemblies 52 and 53 and the user support platform assembly 51 provides ability for collapsing/folding the height adjustable chair apparatus for transport/portability and/or storage. Tensile crossmembers 37 exemplified by straps are preferably located between the anterior leg assembly 53 and the posterior leg assembly 52 to provide movement termination point(s) as the leg assemblies 53/52 pivot to a fully open position, user-supportive configuration.

The tensile crossmembers or straps 37 may also wrap around the anterior and posterior leg assemblies 53 and 52 when in the folded/collapsed configuration to secure the leg assemblies 53 and 52 in the collapsed configuration. The height adjustable chair apparatuses 10 and 50 according to the present invention provide basic benefits of being able to collapse and fold just as standard folding chairs, but with the increased benefits related to the novel and unique features mentioned above.

While the above descriptions contain much specificity, this specificity should not be construed as limitations on the scope of the invention, but rather as an exemplification of the invention. In certain embodiments, the basic invention may be said to essentially teach or disclose a height adjustable chair as exemplified by height adjustable chair apparatuses 10 and 50 for enabling a user to vary a select user support height thereof. The height adjustable chair according to the present invention is believed to essentially comprise a user support platform assembly, a posterior leg assembly, and an anterior leg assembly as described hereinabove.

In a preferred embodiment, the user support platform assembly as at 11 preferably comprises a first platform portion or seat portion as at 14; and a pair of pivot mechanisms as at 15. Each of the pair of pivot mechanisms 15 comprise an upper pivot axis, a lower pivot axis, a leg-bridge portion as at 18, a bridge-to-arm portion as at 19, and a pivot arm portion as at 20. The pair of pivot mechanisms 15 are firstly and pivotally attached to laterally opposed posterior portions 21 of the first platform portion 14 via the leg-bridge portions 18. The upper pivot axes of the pair of pivot mechanisms 15 extend through the leg-bridge portions 18 are thereby axially aligned at the first platform portion 14 along a first posterior pivot axis of rotation as at 101.

The posterior leg assembly as at 12 essentially comprises laterally opposed upper posterior leg portions, laterally opposed lower posterior leg portions extendable relative to the upper posterior leg portions, and a posterior locking mechanism for locking the lower posterior leg portions in extended relation relative to the upper posterior leg portions. The pair of pivot mechanisms 15 are secondly and pivotally attached to the upper posterior leg portions. The lower pivot axes extending orthogonally through the pivot arm portions 20 of the pair of pivot mechanisms 15 are thereby axially aligned at the upper posterior leg portions at the second posterior pivot axis of rotation as at 102.

The anterior leg assembly 13 essentially comprises laterally opposed upper anterior leg portions, laterally opposed lower anterior leg portions extendable relative to the upper anterior leg portions, and an anterior locking mechanism for locking the lower anterior leg portions in extended relation relative to the upper anterior leg portions. The upper anterior leg portions are pivotally attached to laterally opposed anterior portions the first platform portion 14 along a first anterior pivot axis of rotation as at 103.

The anterior leg assembly is further pivotally attached to the posterior leg assembly at a second leg-to-leg anterior pivot axis of rotation as at 104. The first support platform 14 is operable to support a user thereupon. The anterior and posterior leg assemblies together enable the user to vary the height of the first support platform 14 relative to a support surface 100 upon which the height adjustable chair is positioned. The height adjustable chair according to the present invention thereby enables the user to vary a select support height of the chair relative to the support surface.

Figure 17A:
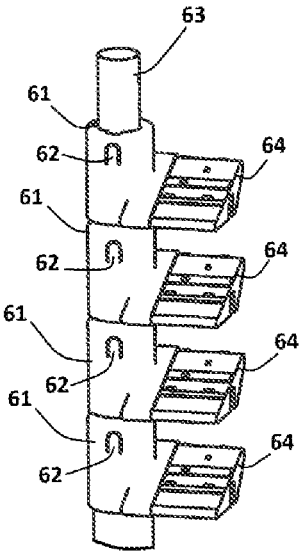
FIG. 17A is a first sequential fragmentary perspective view of an alternative leg assembly unit with a series of individual telescopic leg segments shown in a fully telescopically collapsed configuration.
Figure 17B:
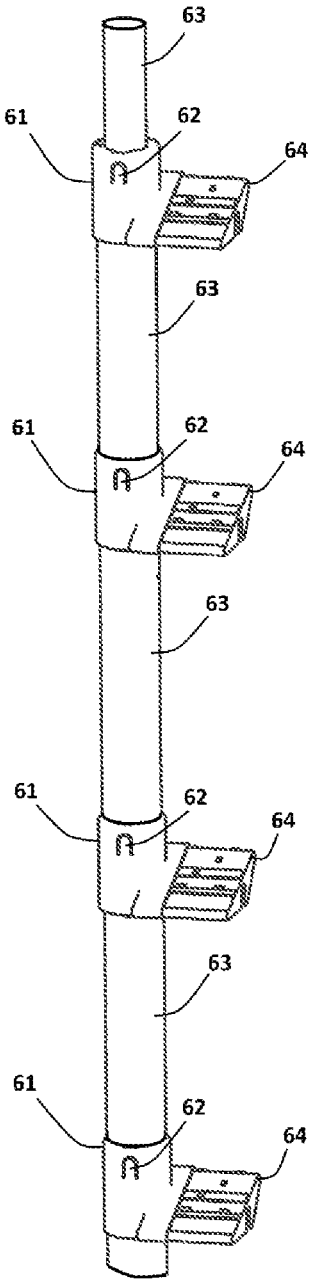
FIG. 17B is a second sequential fragmentary perspective view of the alternative leg assembly unit with the series of individual telescopic leg segments shown in a telescopically extended configuration.

Referencing FIGS. 17A and 17B, the reader will there consider that the present invention contemplates a height adjustable chair assembly whereby both the posterior leg assembly and the anterior leg assembly may preferably comprise a series of telescopic leg segments such that each successive leg segment is outfitted with its own locking mechanism cooperable with the leg segment that telescopes relative thereto for locking the telescoping leg segment in extended relation relative to the locking mechanism. In this regard, FIG. 17A provides a first sequential fragmentary perspective view of an alternative leg assembly unit with a series of individual telescopic leg segments 61 shown in a fully telescopically collapsed configuration.

FIG. 17B is a second sequential fragmentary perspective view of the alternative leg assembly unit with the series of individual telescopic leg segments 61 shown in a telescopically extended configuration. Each individual telescopic leg segment 61 is outfitted with a locking mechanism 62 exemplified by a pin locking mechanism cooperable with a pin-receiving aperture formed in the telescopic leg portion 63 telescopically received thereby. Fragmentary step portions are depicted at 64 which step portions 64 have been fragmented from the series of steps otherwise referenced at 40 for ease of illustration, and tying the structural concept of telescopic leg segments 61 to the height adjustable chairs 10 and 50 as being a further structural option for the present invention. Accordingly, it is contemplated height adjustable chair according to the present invention, in either iteration, may preferably provide a posterior leg assembly and an anterior leg assembly comprising at least one, but optionally a series of individually telescopic leg segments for enabling the user to selectively vary the height of the first platform portion relative to the support surface.

The user support platform assembly preferably comprises a second platform portion or back support portion 16, which second platform portion 16 is pivotally attached to the first platform portion at the first posterior pivot axis of rotation in the preferred embodiment. The user support platform assembly 11 further preferably comprises laterally opposed third platform portions or armrest portions 17, which laterally opposed third platform portions are pivotally attached to laterally opposed portions of the second platform portion 16 along a third posterior pivot axis of rotation as at 105 as well as being pivotally attached to the second leg-to-leg anterior pivot axis of rotation 104 in the preferred embodiment.

The anterior leg assembly comprises an anterior crossmember and the posterior leg assembly comprises a posterior crossmember. The anterior crossmember maintains a fixed first anterior distance between and stabilizes the lower anterior leg portions, and the posterior crossmember maintains a fixed first posterior distance between and stabilizes the lower posterior leg portions. The anterior locking mechanism extends intermediate lower portions of the upper anterior leg portions and the posterior locking mechanism extends intermediate lower portions of the upper posterior leg portions. The anterior locking mechanism maintains a fixed second anterior distance between and stabilizes the upper anterior leg portions. The posterior locking mechanism maintains a fixed second posterior distance between and stabilizes the lower posterior leg portions.

The anterior leg assembly extends in an anterior leg plane as at plane 106 and the posterior leg assembly extends in a posterior leg plane as at plane 107. The anterior leg plane 106 is preferably angled relative to the posterior leg plane 107 at a select oblique angle as at 108. The select oblique angle is preferably between 50 and 55 degrees. In the preferred embodiment, the lower anterior leg portions are telescopically receivable in and extendable from the upper anterior leg portions and the lower posterior leg portions are telescopically receivable in and extendable from the upper posterior leg portions.

An anterior distance or variable height between the first platform portion to a lowermost portion of the lower anterior leg portions provides a first quotient value and a lowermost distance between the lowermost portion of the lower anterior leg portions to a lowermost portion of the lower posterior leg portions provides a second quotient value. The height-to-leg span ratio of the first quotient value to the second quotient value is preferably between 0.60 when in a minimum chair height configuration and 0.75 when in a maximum chair height configuration.

The first, second, and third posterior pivot axes are together cooperable with the first and second anterior pivot and the structural features to enable the user to collapse the height adjustable chair into a collapsed configuration for ease of transport and stowage. A select leg assembly may preferably comprise a series of steps as referenced at 40. The select leg assembly is selected from the group consisting of the anterior leg assembly and the posterior leg assembly, and the series of steps enable the user to more readily access the first platform portion when the height adjustable chair is in an elevated configuration relative to the support surface. An anterior-to-posterior leg assembly crossmember mechanism as at 37 maintains a fixed leg distance between the anterior leg assembly and the posterior leg assembly and stabilizes the same when in a user-support configuration.

In an alternative embodiment, the present invention contemplates a height adjustable chair for enabling a user to vary a select user support height thereof, which height adjustable chair may be said to essentially comprise a user support platform assembly, a posterior leg assembly, and an anterior leg assembly. The user support platform assembly essentially comprises a first platform portion and a pair of pivot mechanisms. The pair of pivot mechanisms each provide first and second pivot axes of rotation, and are firstly and pivotally attached to laterally opposed posterior portions of the user support platform assembly thereby being axially aligned at the first platform portion along a first pivot axis of rotation.

The posterior leg assembly may be said to essentially comprise laterally opposed lower posterior leg portions, laterally opposed upper posterior leg portions extendable relative to the lower posterior leg portions, and a posterior locking mechanism for locking the upper posterior leg portions in extended relation relative to the lower posterior leg portions. The pair of pivot mechanisms secondly and pivotally attach to the upper posterior leg portions thereby being axially aligned at the upper posterior leg portions at a second pivot axis of rotation.

The anterior leg assembly comprising laterally opposed lower anterior leg portions, laterally opposed upper anterior leg portions extendable relative to the lower anterior leg portions, and an anterior locking mechanism for locking the upper anterior leg portions in extended relation relative to the lower anterior leg portions. The upper anterior leg portions are pivotally attached to laterally opposed anterior portions of the first platform portion along a third pivot axis of rotation. The first support platform supports a user, and the anterior and posterior leg assemblies enable the user to vary the height of the first support platform relative to a support surface.

The user support platform assembly of the alternative height adjustable chair may also comprise a second platform portion that pivotally attaches to the first platform portion at the first posterior pivot axis of rotation, and laterally opposed third platform portions that pivotally attach to laterally opposed portions of the second platform portion along a fourth posterior pivot axis of rotation.

The anterior leg assembly comprises at least one anterior crossmember and the posterior leg assembly comprises at least one posterior crossmember, the at least one anterior crossmember maintaining a fixed first anterior distance between the lower anterior leg portions and the at least one posterior crossmember maintaining a fixed first posterior distance between the lower posterior leg portions.

The upper anterior leg portions of the alternative embodiment are preferably telescopically receivable in and extendable from the lower anterior leg portions and the upper posterior leg portions of the alternative embodiment are telescopically receivable in and extendable from the lower posterior leg portions. This feature is optional and not critical to the practice of the alternative embodiment, and the reader will note that the relative leg-to-leg portion extendibility is central to the practice of the present invention.

The first, second, third and fourth pivot axes of rotation are cooperable to enable the user to collapse the height adjustable chair into a collapsed configuration for ease of transport and stowage. The height adjustable chair, as illustrated in connection with the alternative embodiment, may preferably comprise a series of steps for enabling the user to more readily access the first platform portion when the height adjustable chair is in an elevated configuration relative to the support surface. Further, to stabilize alternative embodiment, the invention contemplates an anterior-to-posterior leg assembly crossmember mechanism exemplified by strap-like elements for maintaining a fixed leg distance between the anterior leg assembly and the posterior leg assembly when in a user-support configuration.

Accordingly, although the invention has been described by reference to certain preferred embodiments, it is not intended that the novel arrangement and methods be limited thereby, but that modifications thereof are intended to be included as falling within the broad scope and spirit of the foregoing disclosures and the appended drawings. Insofar as the description above and the accompanying drawings disclose any additional subject matter that is not within the scope of the claims below, the embodiments are not dedicated to the public and the right to file one or more applications to claim such additional embodiments is reserved.

What is claimed is:

1. A collapsible and height adjustable chair for enabling a user to vary a select user support height thereof, the collapsible and height adjustable chair comprising:

a user support platform assembly, the user support platform assembly comprising a first platform portion and a pair of pivot mechanisms, each of the pair of pivot mechanisms being firstly and pivotally attached to laterally opposed posterior portions of the first platform portion, upper pivot axes of the pair of pivot mechanisms thereby being axially aligned at the first platform portion along a first posterior pivot axis of rotation;

a posterior leg assembly, the posterior leg assembly comprising laterally opposed upper posterior leg portions, laterally opposed lower posterior leg portions extendable relative to the upper posterior leg portions, and a posterior locking mechanism for locking the lower posterior leg portions in extended relation relative to the upper posterior leg portions, the pair of pivot mechanisms being secondly and pivotally attached to the upper posterior leg portions, lower pivot axes of the pair of pivot mechanisms thereby being axially aligned at the upper posterior leg portions at a second posterior pivot axis of rotation; and an anterior leg assembly, the anterior leg assembly comprising laterally opposed upper anterior leg portions, laterally opposed lower anterior leg portions extendable relative to the upper anterior leg portions, and an anterior locking mechanism for locking the lower anterior leg portions in extended relation relative to the upper anterior leg portions, the upper anterior leg portions being pivotally attached to laterally opposed anterior portions of the first platform portion along a first anterior pivot axis of rotation, the anterior leg assembly being pivotally attached to the posterior leg assembly at a second anterior pivot axis of rotation;

the first support platform extending in a support plane when the height adjustable chair is supported by a support surface for supporting a user thereupon in elevated relation relative to the support surface, the support plane extending in a select oblique angle relative to the support surface;

the laterally opposed lower posterior leg portions being configured to extend incrementally relative to the upper posterior leg portions and the laterally opposed lower anterior leg portions being configured to extend incrementally relative to the upper anterior leg portions such that posterior incremental extensions of the laterally opposed lower posterior leg portions are greater in length than anterior incremental extensions of laterally opposed lower anterior leg portions for maintaining the select obique angle as the user varies the height of the first support platform relative to the support surface.

2. The height adjustable chair of claim 1 wherein the user support platform assembly comprises a second platform portion, the second platform portion being pivotally attached to the first platform portion at the first posterior pivot axis of rotation.

3. The height adjustable chair of claim 2 wherein the user support platform assembly comprises laterally opposed third platform portions, the laterally opposed third platform portions being pivotally attached to laterally opposed portions of the second platform portion along a third posterior pivot axis of rotation.

4. The height adjustable chair of claim 3 wherein the first, second, and third posterior pivot axes of rotation are cooperable with the first and second anterior pivot axes of rotation to enable the user to collapse the height adjustable chair into a collapsed configuration for ease of transport and storage.

5. The height adjustable chair of claim 1 wherein the anterior leg assembly comprises an anterior crossmember and the posterior leg assembly comprises a posterior crossmember, the anterior crossmember maintaining a fixed first anterior distance between the lower anterior leg portions and the posterior crossmember maintaining a fixed first posterior distance between the lower posterior leg portions.

6. The height adjustable chair of claim 1 wherein the anterior locking mechanism extends intermediate lower portions of the upper anterior leg portions and the posterior locking mechanism extends intermediate lower portions of the upper posterior leg portions, the anterior locking mechanism maintaining a fixed second anterior distance between the upper anterior leg portions, the posterior locking mechanism maintaining a fixed second posterior distance between the upper posterior leg portions.

7. The height adjustable chair of claim 1 wherein the anterior leg assembly extends in an anterior leg plane and the posterior leg assembly extends in a posterior leg plane, the anterior leg plane being angled relative to the posterior leg plane at a select oblique angle, the select oblique angle being between 50 and 55 degrees.

8. The height adjustable chair of claim 7 wherein a vertical height between the first platform portion to a first lower portion of the lower anterior leg portions provides a first quotient value and a horizontal distance between a second lower portion of the lower anterior leg portions to a first lower portion of the lower posterior leg portions provides a second quotient value, the ratio of the first quotient value to the second quotient value being between 0.60 when in a minimum chair height configuration and 0.75 when in a maximum chair height configuration, the posterior incremental extensions and the anterior incremental extensions for supporting the ratio as the user varies the height of the first support platform relative to the support surface.

9. A collapsible and height adjustable chair for enabling a user to vary a select user support height thereof, the collapsible and height adjustable chair comprising:

a user support platform assembly, the user support platform assembly comprising a first platform portion and a pair of pivot mechanisms, each of the pair of pivot mechanisms being firstly and pivotally attached to laterally opposed posterior portions of the user support platform assembly, the pair of pivot mechanisms thereby being axially aligned at the first platform portion along a first pivot axis of rotation;

a posterior leg assembly, the posterior leg assembly comprising laterally opposed lower posterior leg portions, laterally opposed upper posterior leg portions extendable relative to the lower posterior leg portions, and a posterior locking mechanism for locking the upper posterior leg portions in extended relation relative to the lower posterior leg portions, the pair of pivot mechanisms being secondly and pivotally attached to the upper posterior leg portions, the pair of pivot mechanisms thereby being axially aligned at the upper posterior leg portions at a second pivot axis of rotation; and an anterior leg assembly, the anterior leg assembly comprising laterally opposed lower anterior leg portions, laterally opposed upper anterior leg portions extendable relative to the lower anterior leg portions, and an anterior locking mechanism for locking the upper anterior leg portions in extended relation relative to the lower anterior leg portions, the upper anterior leg portions being pivotally attached to laterally opposed anterior portions of the first platform portion along a third pivot axis of rotation;

the first support platform extending in a support plane when the height adjustable chair is supported by a support surface for supporting a user thereupon in elevated relation relative to the support surface, the support plane extending in a select oblique angle relative to the support surface;

the laterally opposed lower posterior leg portions being configured to extend incrementally relative to the upper posterior leg portions and the laterally opposed lower anterior leg portions being configured to extend incrementally relative to the upper anterior leg portions such that posterior incremental extensions of the laterally opposed lower posterior leg portions are greater in length than the anterior incremental extensions of laterally opposed lower anterior leg portions for maintaining the select oblique angle as the user varies the height of the first support platform relative to support surface.

10. The height adjustable chair of claim 9 wherein the user support platform assembly comprises a second platform portion, the second platform portion being pivotally attached to the first platform portion at the first pivot axis of rotation.

11. The height adjustable chair of claim 10 wherein the user support platform assembly comprises laterally opposed third platform portions, the laterally opposed third platform portions being pivotally attached to laterally opposed portions of the second platform portion along a fourth pivot axis of rotation.

12. The height adjustable chair of claim 11 wherein the first, second, third and fourth pivot axes of rotation are cooperable to enable the user to collapse the height adjustable chair into a collapsed configuration for ease of transport and storage.

13. The height adjustable chair of claim 9 wherein the anterior leg assembly comprises at least one anterior crossmember and the posterior leg assembly comprises at least one posterior crossmember, the at least one anterior crossmember maintaining a fixed first anterior distance between the lower anterior leg portions and the at least one posterior crossmember maintaining a fixed first posterior distance between the lower posterior leg portions.

14. A height adjustable chair, the height adjustable chair comprising:

a user support platform assembly, the user support platform assembly comprising a first platform portion;

a posterior leg assembly, the posterior leg assembly comprising posterior leg portions incrementally extendable relative to one another and a posterior locking mechanism for locking the posterior leg portions in incrementally extended relation relative to one another; and an anterior leg assembly, the anterior leg assembly comprising anterior leg portions incrementally extendable relative to one another and an anterior locking mechanism for locking the anterior leg portions in incrementally extended relation relative to one another;

the first support platform extending in a support plane when the height adjustable chair is supported by a support surface for supporting a user thereupon in elevated relation relative to the support surface, the support plane extending in a select oblique angle relative to the support surface;

the posterior leg portions being configured to extend incrementally such that posterior incremental extensions are greater in length than the anterior incremental extensions of the anterior leg portions for maintaining the select oblique angle as the user varies the height of the first support platform relative to the support surface.

15. The height adjustable chair of claim 14 wherein the user support platform assembly comprises a second platform portion and laterally opposed third platform portions.

16. The height adjustable chair of claim 15 comprising a series of pivot axes, the series of pivot axes enabling the user to collapse the height adjustable chair into a collapsed configuration for ease of transport and storage.

17. The height adjustable chair of claim 14 wherein the anterior leg assembly comprises at least one anterior crossmember and the posterior leg assembly comprises at least one posterior crossmember, the at least one anterior crossmember maintaining a fixed distance between the anterior leg portions and the at least one posterior crossmember maintaining a fixed distance between the posterior leg portions.

18. The height adjustable chair of claim 14 comprising a series of steps, the series of steps for enabling the user to more readily access the first platform portion when the height adjustable chair is in an elevated configuration relative to the support surface.

19. The height adjustable chair of claim 14 comprising an anterior-to-posterior leg assembly crossmember mechanism, the anterior-to-posterior leg assembly crossmember mechanism for maintaining a fixed leg distance between the anterior leg assembly and the posterior leg assembly when in a user-support configuration.

20. The height adjustable chair of claim 14 wherein the posterior leg assembly and the anterior leg assembly each comprise a series of telescopic leg segments for enabling the user to selectively vary the height of the first platform portion relative to the support surface.

* * * * *